US006387609B1

(12) United States Patent
Ochiai

(10) Patent No.: US 6,387,609 B1
(45) Date of Patent: May 14, 2002

(54) SILVER HALIDE EMULSION, AND COLOR PHOTOGRAPHIC LIGHT-SENSITIVE MATERIAL AND IMAGE-FORMING METHOD USING THE SAME

(75) Inventor: Yoshiro Ochiai, Minami-ashigara (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 0 days.

(21) Appl. No.: 09/672,001

(22) Filed: Sep. 29, 2000

(30) Foreign Application Priority Data

Sep. 29, 1999 (JP) ..... 11-277132

(51) Int. Cl.[7] ..... G03C 1/005
(52) U.S. Cl. ..... 430/567
(58) Field of Search ..... 430/567

(56) References Cited

U.S. PATENT DOCUMENTS

| | | | | |
|---|---|---|---|---|
| 4,400,463 | A | 8/1983 | Maskasky | 430/434 |
| 5,185,239 | A | 2/1993 | Maskasky | 430/569 |
| 5,272,052 | A | 12/1993 | Maskasky | 430/569 |
| 5,561,039 | A | 10/1996 | Ochiai | 430/575 |
| 5,667,949 | A | 9/1997 | Szajewski | 430/489 |
| 5,691,128 | A | 11/1997 | Ohzeki et al. | 430/569 |
| 5,723,278 | A | 3/1998 | Jagannathan et al. | |

FOREIGN PATENT DOCUMENTS

EP 0809139 A1 11/1997

*Primary Examiner*—Hoa Van Le

(57) ABSTRACT

There is disclosed a spectrally and chemically sensitized silver halide emulsion, which comprises silver halide grains, wherein 50% or more of total projected area of the grains is provided by tabular grains having {111} principal planes and an aspect ratio of 2.0 or more, and said tabular grains contain silver iodobromochloride or bromochloride grains each having an AgCl content of 90 mole % or more, and having angular corners. There is also disclosed a silver halide color photographic light-sensitive material containing the silver halide emulsion in at least one silver halide emulsion layer, and image-forming method comprising subjecting the material to scanning exposure, and then conducting color development. The present invention provides a silver halide emulsion, which is monodispersed, high-speed, and high contrast emulsion excellent in grain shape stability of {111} tabular grains; and, the emulsion improves high illumination reciprocity law failure and latent image stability after exposure to light. The present invention further provides a color photographic light-sensitive material using the emulsion, and image-forming method that exerts photographic characteristics of the above-described emulsion or material even when they are processed by rapid processing using a scanning exposure.

12 Claims, 5 Drawing Sheets

SILVER HALIDE EMULSION, AND COLOR PHOTOGRAPHIC LIGHT-SENSITIVE MATERIAL AND IMAGE-FORMING METHOD USING THE SAME

FIELD OF THE INVENTION

The present invention relates to a silver halide emulsion containing silver halide tabular grains having a high silver chloride content (hereinafter referred to as a high silver chloride tabular grains) and having {111} planes as principal planes. Further, the present invention relates to both a color photographic light-sensitive material and an image formation method, using the emulsion. Particularly, the present invention relates to a monodisperse, high-speed, and hard gradation (high contrast) emulsion that is excellent in grain shape stability; and to both a color photographic light-sensitive material and an image formation method (particularly, an image formation method that utilizes of a high illumination intensity and short time exposure), using the emulsion.

BACKGROUND OF THE INVENTION

As a method for forming tabular silver halide emulsion grains having {111} major planes, for example, U.S. Pat. Nos. 4,400,463, 5,185,239, and 5,176,991, JP-A-63-213836 (the term "JP-A" as used herein means an "unexamined published Japanese patent application"), and U.S. Pat. Nos. 5,176,992 and 5,691,128, disclose a method of forming grains in the presence of crystal habit-controlling agents, i.e. amino azaindenes, triaminopyrimidines, hydroxyaminoazines, thioureas, xanthonoides, and pyridinium salts, respectively.

It is well known in the art that high silver chloride grains originally have a characteristic that selectively {100} planes are apt to come out, and consequently the grains that are ordinarily formed are cubic. In the foregoing patents/publications, with utilizing a crystal habit-controlling agent, tabular grains are formed so that originally unstable {111} planes come out on the grain surface. Therefore, the moment desorption of the crystal habit-controlling agent from the grain surface is occurred, high silver chloride {111} tabular grains are redissolved, and {100} planes arise on the grain surface, so that it is difficult to maintain the grain shape. Further, it is difficult to expect to attain high sensitivity by spectral and chemical sensitization, without desorption of the crystal habit-controlling agent from the grains.

U.S. Pat. No. 5,691,128 discloses that the strength of adsorption of a crystal habit-controlling agent is controlled by pH-regulation, and exchange adsorption is made between a sensitizing dye and the crystal habit-controlling agent, thereby achieving compatibility between stabilization of the grain shape and enhancement of sensitivity.

Further, U.S. Pat. No. 5,272,052 discloses that composite grains composed of host grains and epitaxial portions (epitaxies) can be formed by epitaxially growing silver bromide selectively at the apexes (corners) of a grains by means of adsorption of a crystal habit-controlling agent, which is then replaced on the tabular grain surface by exchange adsorption of a photographically useful compound.

However, these epitaxial grains were also insufficient for a practical use, because during or after the spectral and chemical sensitization, these grains momentarily changed the adsorption state of dyes and the grain shapes, when they were in a condition where a crystal habit-controlling agent had been desorbed from the grains. Especially, the halogen composition of the epitaxial portion was unstable.

SUMMARY OF THE INVENTION

An object of the present invention is to provide a silver halide emulsion that is excellent in grain shape stability of {111} tabular grains, and that is a monodisperse, high-speed, and high contrast emulsion, and moreover that is able to concurrently improve both high illumination intensity reciprocity law failure and latent-image stability after exposure to light. Further, another object of the present invention is to provide a high-speed, and high contrast color photographic light-sensitive material that is able to concurrently improve both high illumination intensity reciprocity law failure and latent-image stability after exposure to light. Further, another object of the present invention is to provide an image formation method that is able to exert photographic characteristics of the above-described emulsion or light-sensitive material even when they are subjected to a rapid processing by means of a scanning exposure and so on.

Other and further objects, features, and advantages of the invention will appear more fully from the following description, taken in connection with the accompanying drawings.

DETAILED DESCRIPTION OF THE INVENTION

Figure 1:
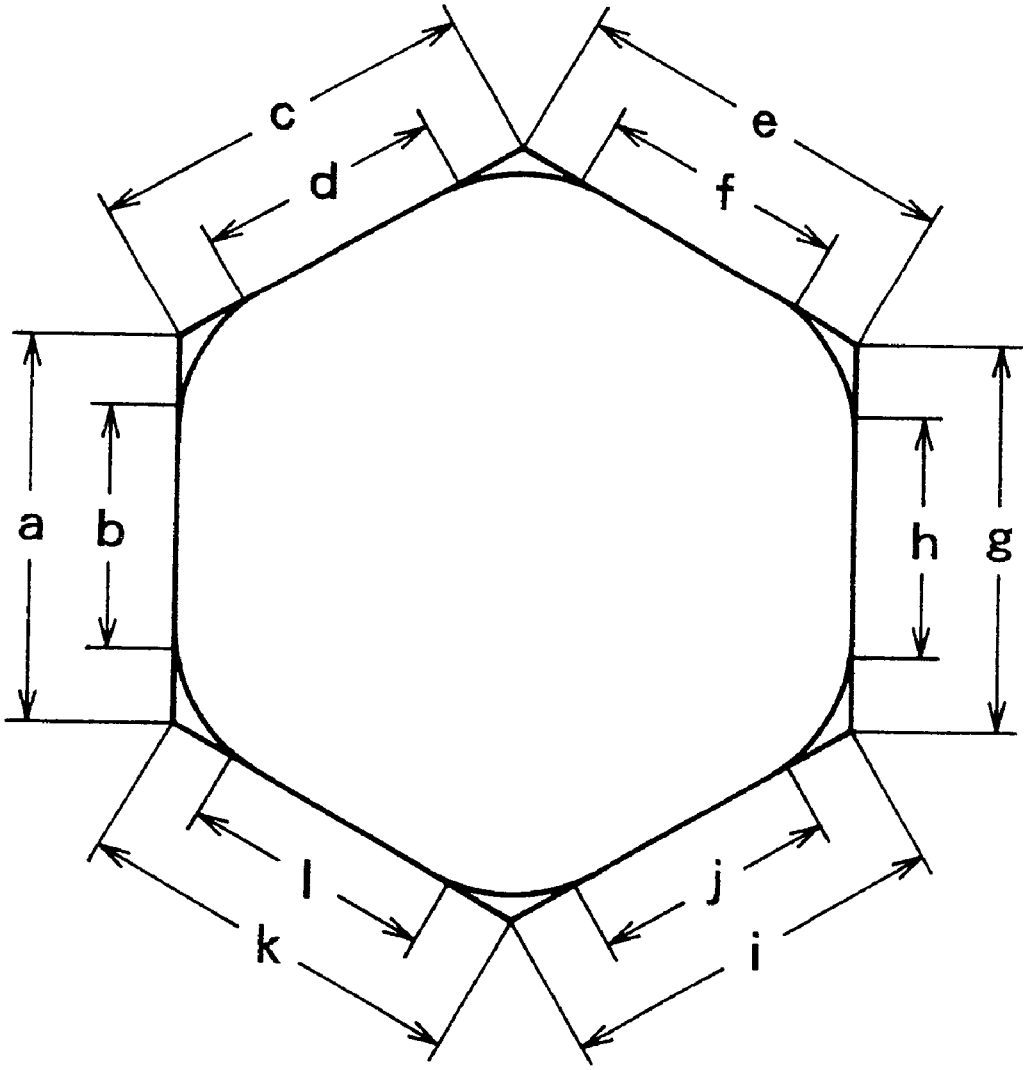
FIG. 1 is an explanatory view for the ratio of the straight-line portion on a silver halide grain.

The present inventor has found that the above-described objects are effectively accomplished by the inventions described below.

(1) A spectrally and chemically sensitized silver halide emulsion comprising silver halide grains, wherein 50% or more of total projected area of the silver halide grains is provided by tabular grains having {111} planes as principal planes and having an aspect ratio of 2.0 or more, and said tabular grains contain silver iodobromochloride grains or silver bromochloride grains each having a silver chloride content of 90 mole % or more, with all corners of said high silver chloride grains being angular.

(2) The silver halide emulsion as described in the above item (1), wherein an equivalent-sphere diameter of each of the silver halide grains is 0.7 $\mu$m or less.

(3) The silver halide emulsion as described in the above item (1) or (2), wherein the emulsion comprises a thiocyanate in an amount of $1\times10^{-4}$ to $3\times10^{-3}$ mol per mol of silver halide.

(4) The silver halide emulsion as described in any one of the above items (1) to (3), wherein the emulsion is chemically sensitized with a gold compound.

(5) The silver halide emulsion as described in any one of the above items (1) to (4), wherein the emulsion comprises a thiosulfonic acid compound in an amount of $1\times10^{-6}$ to $5\times10^{-3}$ mol per mol of silver halide, and a sulfinic acid compound in an amount of $1\times10^{-6}$ to $1\times10^{-3}$ mol per mol of silver halide.

(6) The silver halide emulsion as described in the above item (1), wherein said silver iodobromochloride grains, or said silver bromochloride grains, have a band of a silver bromide localized phase formed at the outermost layer of side faces in relation to the principal planes.

(7) A silver halide color photographic light-sensitive material, which comprises, on a support, at least a silver halide emulsion layer containing a yellow dye-forming coupler, a silver halide emulsion layer containing a magenta dye-forming coupler, and a silver halide emulsion layer containing a cyan dye-forming coupler, wherein at least one of said emulsion layers comprises the silver halide emulsion as described in any one of the above items (1) to (6).

(8) An image-forming method, comprising subjecting the silver halide color photographic light-sensitive material as described in the above item (7) to a scanning exposure, followed by a color development process.

(9) The image-forming method as described in the above item (8), wherein the time required for said color development process is 20 seconds or less.

(10) The image-forming method as described in the above item (8), or (9), wherein said scanning exposure is carried out using a visible laser beam light of $10^{-4}$ seconds or less per pixel.

The silver halide emulsion of the present invention comprises tabular grains (a) having {111} planes as principal planes, (b) exhibiting a thickness of preferably 0.01 to 0.30 μm, more preferably 0.02 to 0.20 μm, further more preferably 0.05 to 0.15 μm, (c) exhibiting an aspect ratio of preferably 2.0 to 100, more preferably 2.0 to 50, further more preferably 4.0 to 50, particularly preferably 6.0 to 50, and (d) exhibiting a projected diameter of preferably 0.1 to 10 μm, more preferably 0.2 to 5.0 μm, further more preferably 0.3 to 2 μm, and which tabular grains occupy, generally, 50 to 100%, preferably 80 to 100%, more preferably 90 to 100%, further more preferably 95 to 100% of total grain projected area. The coefficient of variation of the projected area or the thickness (standard deviation of distribution/average projected diameter or average thickness) is preferably in the range of 0 to 0.4, more preferably in the range of 0 to 0.3, further more preferably in the range of 0.01 to 0.2. The term "aspect ratio" refers to a value obtained by dividing the diameter of a circle having an area equivalent to the projected area of a grain, by the thickness of the grain. The larger the aspect ratio, the thickness of grains becomes thinner and flatter. In the present invention, the term "tabular grain" is employed to embrace a grain having an aspect ratio of 1.2 or more. The term "average aspect ratio" means an average value of aspect ratios of total tabular grains in an emulsion. Further, the term "projected diameter" refers to the diameter of a circle having an area equivalent to the projected area of a grain. The term "thickness" is defined by the distance between the two parallel main planes of a tabular grain. The term "projected diameter of a tabular grain" refers to the diameter of the circle having an area equivalent to the projected area of the tabular grain, which project area is measured under the conditions that a tabular grain is placed so that its principal planes become parallel to a substrate plane, and the tabular grain is observed from the direction perpendicular to the parallel direction.

The emulsion of the present invention has the silver chloride content of generally 90 mol % or more, preferably in the range of 90 to 99.99 mol %, more preferably in the range of 95 to 99.9 mol %, further more preferably in the range of 98 to 99.9 mol %.

The silver bromide content according to the present invention is preferably in the range of 0.01 to 5 mol %, more preferably in the range of 0.05 to 3 mol %, further more preferably in the range of 0.1 to 2 mol %.

The silver iodide content according to the present invention is preferably in the range of 0.01 to 1 mol %, more preferably in the range of 0.05 to 0.7 mol %, further more preferably in the range of 0.1 to 0.5 mol %.

As to the shape of the silver halide grains in the silver halide emulsion of the present invention, they are tabular grains whose principal planes are in a shape of a hexagon, and the ratio of the lengths of nearest neighboring sides is preferably 1 to 2.

The term "angular" means that a corner of the plane is neither rounded nor protruded, and that an intersecting point, which is formed by extending two straight-line portions of neighboring sides, on the principal plane, is substantially coincident with the actual corner. The term "substantially coincident with the actual corner" means that the straight-line portion ratio of generally 0.8 or greater, preferably 0.9 or greater, and more preferably 0.95 to 1.0.

The term "straight-line portion ratio" refers to, for example, in the case of a hexagonal grain as shown in FIG. 1, a ratio of a sum of the lengths of straight-line portions at sides of the hexagonal grain to a sum of side lengths of the hexagon that is formed by intersecting points (6 points) of extended lines of the straight-line portions for the respective neighboring sides. (Straight-line portion ratio=(sum of lengths of straight-line portions of a tabular grain/sum of distances between intersecting points of extended lines)={(b+d+f+h+j+l)/(a+c+e+g+i+k)}). As a matter of course, if a grain has no straight-line portion, the straight-line portion ratio is zero.

Further, in the present invention, if a grain has an intersecting point of an extended line of the straight-line portion and another extended line of the straight-line portion of the neighboring sides, that exists in the interior of the grain, the grain is considered as a rounded grain even though its corner is sharply-pointed. That is, such a grain does not fall within the definition of the grains of the present invention. For example, a composite grain, in which an epitaxial growth is observed at a corner of the grain, or a grain carrying thereon a projection, is considered to be a rounded grain.

The term a "grain all corners of which are angular" used in the present invention does not embrace pointed grains having projecting corner(s).

Silver halide grains in the silver halide emulsion of the present invention are tabular grains having an equivalent-sphere diameter of preferably 0.7 μm or less, more preferably 0.1 to 0.5 μm. The term "equivalent-sphere diameter" refers to the diameter of a sphere having a volume equivalent to the volume of a grain.

The preparation steps of the silver halide emulsion of the present invention include, a silver halide grain-forming step comprising a reaction between a water-soluble silver salt and a water-soluble halide, a desalting step, and a chemical sensitization step, as generally well known.

Silver halide grains in the emulsion of the present invention are composed of silver iodobromochloride grains or silver bromochloride grains. Silver iodobromochloride grains are particularly preferred in the viewpoint of grain shape stability.

As to the location of silver bromide in the silver halide grains (preferably silver iodobromochloride grains) according to the present invention, the silver bromide preferably presents locally in the grain rather than presents uniformly in the grain. Particularly preferably, the silver bromide is locally present in the outermost layer of each of the sides that connect two parallel principal planes having {111} planes. Such silver bromide-localized phase according to the present invention is composed of not a usual epitaxial phase, but a band-like continuous phase.

The silver bromide content of the silver bromide-localized phase according to the present invention is preferably in the range of 5 to 100 mol %, more preferably in the range of 10 to 100 mol %, and most preferably in the range of 30 to 100 mol %. The use of the silver bromide-localized phase not only prevents the corners of the grain from being rounded, but also improves the grain shape stability significantly. Further, as a result, a change of the maximum absorption wavelength of a sensitizing dye, attendant upon the adsorption of the sensitizing dye, during the period of from after spectral sensitization to the completion of chemical sensitization, becomes extremely small. In the present invention, the change of the maximum absorption wavelength is preferably 10 nm or less, and more preferably in the range of 0 to 5 nm.

The emulsion of the present invention can be produced, for example, by adding a silver nitrate aqueous solution and an aqueous solution of a bromide salt (e.g., potassium bromide, sodium bromide) after forming {111} tabular grains. At this time, it is important that the temperature in the reaction system to which these solutions added, is 40° C. or more. Further, the reaction system is controlled at a constant temperature of preferably 50° C. to 80° C., and more preferably 60° C. to 80° C. Furthermore, the silver potential in the reaction system is preferably 100 mV or less, and more preferably in the range of 80 mV to 40 mV.

The emulsion of the present invention preferably contains a thiocyanate, with typical examples including sodium thiocyanate and potassium thiocyanate. The timing of addition is not limited to any particular step(s). However, it is preferable that these salts are added at any time of the period ranging from after the grain formation to the completion of chemical sensitization. The amount of the thiocyanate to be added is preferably in the range of $1\times10^{-4}$ mol to $3\times10^{-3}$ mol, and more preferably in the range of $2\times10^{-4}$ mol to $1\times10^{-3}$ mol.

In the silver halide emulsion of the present invention, various multivalent metal ion impurities may be incorporated at the step of emulsion grain formation or physical ripening. Examples of the compounds to be used include salts or complex salts of Group VIII metals of periodic table, such as iron, iridium, ruthenium, osmium, rhenium, rhodium, cadmium, zinc, lead, copper, and thallium. In the present invention, a metal compound composed of the metal such as iron, ruthenium, osmium, and rhenium, and which compound has at least four cyan ligands, is especially preferred in the viewpoints of both further enhancement of high illumination intensity sensitivity and repression of latent image sensitization. Further, an iridium compound provides tremendous effect on the impartment of suitability for high illumination intensity exposure. The amount of these compounds to be added, varies in accordance with the object of using them, however the amount is preferably in the range of $10^{-9}$ mol to $10^{-2}$ mol per mol of silver halide. These metal ions are explained in more detail. However, the present invention is not limited thereto.

The iridium ion-containing compound is a trivalent or tetravalent iridium salt or complex salt, with the latter being preferred. For example, halides, amines, or oxarato complex salts, such as iridium (III) chloride, iridium (III) bromide, iridium (IV) chloride, sodium hexachloro iridate (III), potassium hexachloro iridate (IV), hexaammine iridium (IV) salt, trioxalato iridium (III) salt, and trioxalato iridium (IV) salt are preferred. The platinum ion-containing compound is a divalent or tetravalent platinum salt or complex salt, with the latter being preferred. For example, there can be used platinum (IV) chloride, potassium hexachloro platinate (IV), tetrachloro platinic acid (II), tetrabromo platinic acid (II), sodium tetrakis (thiocyanato) platinate (IV), hexaammine platinum (IV) chloride, and so on.

The palladium ion-containing compound is generally a divalent or tetravalent palladium salt or complex salt, with the latter being preferred. For example, there can be used sodium tetrachloro palladate (II), sodium tetrachloro palladate (IV), potassium hexachloro palladate (IV), tetraammine palladium (II) chloride, potassium tetracyano palladate (II), and so on. As a nickel ion-containing compound, there can be used nickel chloride, nickel bromide, potassium tetrachloro nickelate (II), hexaammine nickel (II) chloride, sodium tetracyano nickelate (II), and so on.

Generally, the rhodium ion-containing compound is preferably a trivalent rhodium salt or complex salt. For example, there can be used potassium hexachlororhodate, sodium hexabromorhodate, ammonium hexachlororhodate, and so on. The iron ion-containing compound is a divalent or trivalent iron ion-containing compound. An iron salt or iron complex salt, which is soluble in water over the range of a density of the compound to be used, is preferred. An iron complex salt, which is easily contained in silver halide grains, is especially preferred. Examples of the iron complex salt include ferrous chloride, ferric chloride, ferrous hydroxide, ferric hydroxide, ferrous thiocyanate, ferric thiocyanate, hexacyano iron (II) complex salt, hexacyano iron (III) complex salt, ferrous thiocyanate complex salt, and ferric thiocyanato complex salt. Further, 6-coordinated metal complex salts having at least four cyan ligands, as described in EP-A-0,336,426 A are also preferably used.

The foregoing metal ion-providing compounds may be doped in the silver halide grains of the present invention, at the time of silver halide grain formation, by adding them in an aqueous solution of gelatin as a dispersing medium, in an aqueous halide solution, in an aqueous silver salt solution, or another aqueous solution, or alternatively, by adding silver halide fine grains previously having metal ions doped therein, and then dissolving the fine grains. Further, doping of the metal ion for use in the present invention, into said grains may be carried out before grain formation, during grain formation, or just after grain formation. The timing of addition may be changed in accordance with the location of metal ions to be doped in the grain.

The silver halide emulsion of the present invention is subjected to chemical sensitization. As the chemical sensitization method, sulfur sensitization represented by the addition of an unstable sulfur compound, noble metal sensitization represented by gold sensitization, reduction sensitization, and the like can be used singly or in combination. As the compound to be used in the chemical sensitization, those described in JP-A-62-215272, page 18, lower right column, to page 22, upper right column, are preferably used.

Preferably, the silver halide emulsion of the present invention is subjected to gold sensitization known in this field. This is because by subjecting to gold sensitization, fluctuation in photographic performance upon scanning exposure with laser light and the like can be more decreased. To carry out the gold sensitization, a compound, for example, chloroauric acid or its salt, gold thiocyanates, or gold thiosulfates may be used. The amount of these compounds to be added, though it may be changed in a wide range depending upon the case, is generally $5\times10^{-7}$ to 5×10−3 mol, and preferable 1×10−6 to $1\times10^{-4}$ mol per mol of silver halide.

In the present invention, gold sensitization may be combined with another sensitization, such as sulfur sensitization, selenium sensitization, tellurium sensitization, reduction sensitization, and sensitization using a noble metal other than a gold compound.

Preferably, the emulsion of the present invention contains a thiosulfonic acid compound and a sulfinic acid compound. It is particularly preferable to contain a thiosulfonic acid compound and a sulfinic acid compound represented by formulae (X) and (Y), respectively.

$R^{21}$—$SO_2S$—$M^{21}$ formula (X)

$R^{22}$—$SO_2$—$M^{22}$ formula (Y)

In formulae (X) and (Y), $R^{21}$ and $R^{22}$ each independently represent an aliphatic group, an aromatic group, or a heterocyclic group, and $M^{21}$ and $M^{22}$ each independently represent a cation. The aliphatic group each represented by $R^{21}$ and $R^{22}$ in formulae (X) and (Y) includes a straight-chain, branched-chain, or cyclic alkyl, alkenyl and alkynyl group. The number of carbon atoms of the aliphatic group, is not limited in particular. However, the number of carbon atoms is preferably a number, which is able to impart solubility in water; in an organic solvent including ethyl acetate, lower alcohols such as methanol and ethanol; or in a mixed solvent thereof.

The aromatic group represented by $R^{21}$ and $R^{22}$ includes a phenyl group and a naphthyl group. As a heterocyclic group represented by $R^{21}$ and $R^{22}$, a 5- to 7-membered ring containing at least one of nitrogen, oxygen, and sulfur atom as hetero atom(s), is preferred. The above-said ring may be saturated or unsaturated. Further, another ring such as a benzene ring may be condensed therewith.

As to substituent(s) that can substitute these aliphatic, aromatic, and heterocyclic groups, the number and kind of the substituent are not limited in particular. However, it is preferable to use a substituent, which accelerates or at least does not prevent dissolution of the compound, in water, or an organic solvent as exemplified above.

Examples of the substituent include an alkoxy group, an aryl group, an alkyl group, a halogen atom, an amino group, a carboxyl group, a hydroxyl group, and a heterocyclic group.

As to a cation represented by $M^{21}$ and $M^{22}$, alkali metal ions (e.g., $Li^+$, $Na^+$, $K^+$) and ammonium ion (e.g., $NH_4^+$, tetraethylammonium ion), can be mentioned.

Typical specific examples of the thiosulfonic acid compound and the sulfinic acid compound are shown below.

(X-1)

$CH_3SO_2SNa$ (X-2)

$C_2H_5SO_2SNa$ (X-3)

$C_2H_5SO_2SK$ (X-4)

$C_4H_9SO_2SLi$ (X-5)

$C_6H_{13}SO_2SNa$

-continued (X-6)

$C_8H_{17}SO_2SNa$ (X-7)

$CH_3(CH_2)_3CH(C_2H_5)CH_2SO_2S{\bullet}NH_4$ (X-8)

$C_{10}H_{21}SO_2SNa$ (X-9)

$C_{12}H_{25}SO_2SNa$ (X-10)

$C_{16}H_{33}SO_2SNa$ (X-11)

$(CH_3)_2CH—SO_2SK$ (X-12)

$t\text{-}C_4H_9SO_2SNa$ (X-13)

$CH_3OCH_2CH_2SO_2S{\bullet}Na$ (X-14)

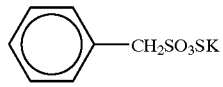

(X-15)

$CH_2{=}CHCH_2SO_2SNa$ (X-16)

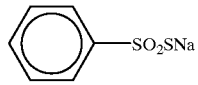

(X-17)

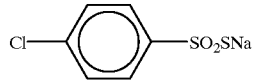

(X-18)

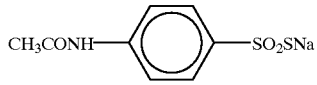

(X-19)

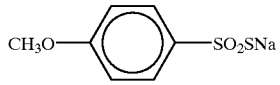

(X-20)

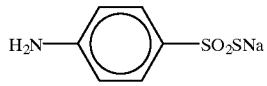

(X-21)

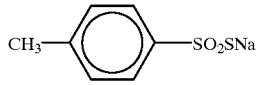

(X-22)

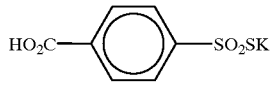

-continued (X-23)

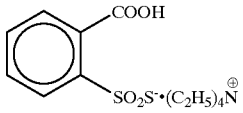

(X-24)

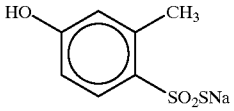

(X-25)

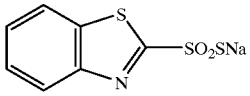

(X-26)

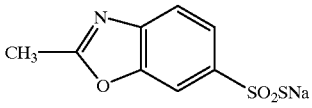

(X-27)

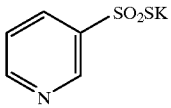

(X-28)

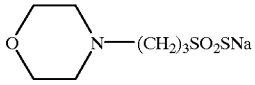

The amount of thiosulfonic acid compound to be added is preferably $1\times10^{-6}$ to $5\times10^{-3}$ mol, more preferably $3\times10^{-6}$ to $5\times10^{-4}$ mol per mole of silver halide.

(Y-1)

$CH_3SO_2\cdot Na$ (Y-2)

$C_2H_5SO_2\cdot Na$ (Y-3)

$C_2H_5SO_2\cdot K$ (Y-4)

$C_4H_9SO_2\cdot Li$ (Y-5)

$C_6H_{13}SO_2\cdot Na$ (Y-6)

$C_8H_{17}SO_2\cdot Na$ (Y-7)

$CH_3(CH_2)_3CH(C_2H_5)CH_2SO_2\cdot NH_4$ (Y-8)

$C_{10}H_{21}SO_2\cdot Na$ (Y-9)

$C_{12}H_{25}SO_2\cdot Na$ (Y-10)

$C_{16}H_{33}SO_2\cdot Na$ (Y-11)

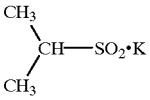

-continued (Y-12)

$t\text{-}C_4H_9SO_2\cdot Na$ (Y-13)

$CH_3OCH_2CH_2SO_2\cdot Na$ (Y-14)

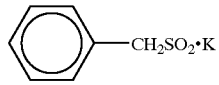

(Y-15)

$CH_2{=}CHCH_2SO_2\cdot Na$ (Y-16)

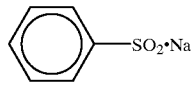

(Y-17)

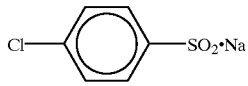

(Y-18)

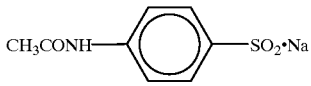

(Y-19)

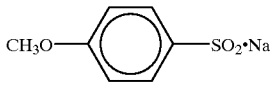

(Y-20)

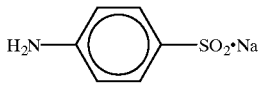

(Y-21)

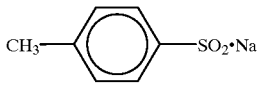

(Y-22)

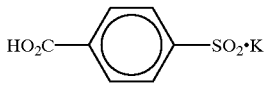

(Y-23)

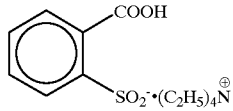

(Y-24)

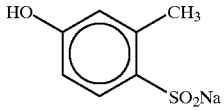

(Y-25)

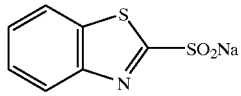

(Y-26)

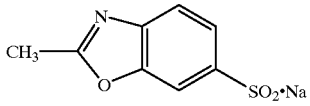

-continued (Y-27)

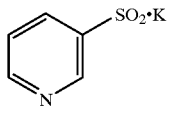

(Y-28)

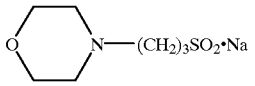

The amount of sulfinic acid compound to be added is preferably $1\times10^{-6}$ to $1\times10^{-3}$ mol, more preferably $3\times10^{-6}$ to $4\times10^{-4}$ mol per mole of silver halide.

Preferably, a mixture of the thiosulfonic acid compound and the sulfinic acid compound in each of addition amounts is prepared in advance, and then the resultant mixture is added (these compounds are added at the same time). The timing of addition of the mixture is not limited to any particular step. However, it is preferable to add the mixture during grain formation and chemical sensitization step. It is more preferable to add the mixture not later than the 50% completion of the grain formation, and further at the initial stage of the chemical sensitization.

In the silver halide emulsion of the present invention, various compounds can be incorporated for the purpose of preventing fogging during the process of the production of the photographic material, during the storage of the photographic material, or during the photographic processing, or for the purpose of stabilizing the photographic performance. That is, compounds known as antifoggants or stabilizers can be added, such as azoles including benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly 1-phenyl-5-mercaptotetrazole or the like), mercaptopyrimidines, mercaptotriazines; thioketo compounds, such as oxazolinthione; and azaindenes, such as triazaindenes; tetraazaindenes (particularly 4-hydroxy-substituted(1,3,3a,7)tetraazaindenes), pentaazaindenes; benzenethiosulfonic acid, benzensulfinic acid, benzenesulfonic acid amides. Mercaptotetrazoles are particularly preferable. These compounds are preferable since they function to further enhance high illumination intensity sensitivity in addition to anti-fogging function and stabilization.

In the silver halide color photographic light-sensitive material according to the present invention, gelatin is used as a hydrophilic binder. As occasion demands, gelatin may be used in combination with hydrophilic colloids, for example, other gelatin derivatives, graft polymers of gelatin and another polymer, proteins other than gelatin, sugar derivatives, cellulose derivatives, and synthetic hydrophilic macromolecular materials such as homo- or co-polymers.

Gelatin, which is used in a silver halide color photographic light-sensitive material according to the present invention, may be a lime-processed gelatin, or an acid-processed gelatin. Alternatively, a gelatin made from any of raw materials such as a cattle (beef) bone, a calfskin, and a pig skin, also may be used. Preferred is a lime-processed gelatin made from a cattle bone, or a pig skin as a raw material.

In the present invention, the total amount of a hydrophilic binder, contained in light-sensitive silver halide emulsion layers and non-light-sensitive hydrophilic colloid layers consisting of from the layer nearest to a support to the hydrophilic colloid layer further-most from the support, all of which layers lie at the silver halide emulsion layer-coating side on the support, is preferably 6.5 g/m$^2$ or less, and most preferably 5.5 g/m$^2$ or less but 4.0 g/m$^2$ or more from the viewpoint of rapid processability. The smaller an amount of a hydrophilic binder is, the more effective it is to advances in (to make more rapid) processing speed of color development and washing steps, in particular.

In the present invention, preferably the ratio of [amount of hydrophilic binder/thickness of silver halide (emulsion)] in the every silver halide emulsion layer, is in the range of 1.5 or more. The ratio in the present invention is hereinafter referred to as the [B/AgX] ratio.

In this specification, the term "an amount of a hydrophilic binder" means an amount (g/m$^2$) of a hydrophilic binder per m$^2$ of the silver halide emulsion layer. The amount of a hydrophilic binder divided by its specific gravity means a thickness. Accordingly, the amount of a hydrophilic binder referred to in the present invention is in proportion to the thickness.

On the other hand, the term "thickness of silver halide emulsion" means a thickness ($\mu$m) at which silver halide emulsion grains in the silver halide emulsion layer occupy in the direction perpendicular to a support. Assuming that a silver halide emulsion layer is ideally coated, in the present invention, a side length ($\mu$m) of the cube (when the silver halide grains are cubic), and a thickness ($\mu$m) in the direction perpendicular to main planes (when the silver halide grains are tabular), are defined as a thickness of silver halide emulsion, respectively. Further, when two or more kinds of silver halide emulsion grains having a different grain size from each other is used in mixture, a weight average value of individual grains is defined as the thickness of a silver halide emulsion.

As is apparent from the above-mentioned definition, the ratio of [B/AgX] in the present invention means that the bigger the value is, the relatively smaller the thickness of an emulsion in the emulsion layer is. From the viewpoints of restraint of pressure-induced fog streaks and reduction in processing color contamination (color mix), the ratio of [B/AgX] in the present invention is generally 1.50 or more, preferably 1.70 or more, more preferably 1.90 or more, and most preferably 6.0 or more.

In the present invention, a silver halide emulsion layer containing a yellow coupler is coated on a support in arbitrary position, and it is preferable to be coated in the position further from the support than at least one layer of a silver halide emulsion layer containing a magenta coupler or a silver halide emulsion layer containing a cyan coupler. Further, the embodiment that a silver halide emulsion layer containing a yellow coupler is coated on the position further-most from a support than any other silver halide emulsion layers, is more preferred from viewpoints of acceleration of rapidity of color development and desilvering, and reduction of residual color occurring due to a remaining sensitizing dye. Further, in the present invention, it is preferable that a cyan coupler-containing silver halide emulsion layer is positioned between a yellow coupler-containing silver halide emulsion layer and a magenta coupler-containing silver halide emulsion layer from a viewpoint of preventing reduction in a cyan density due to the blix discoloration, whereas the cyan coupler-containing silver halide emulsion layer is at the position closest to a support from a viewpoint of improving a light fading. Further, each of the yellow color-forming layer, the magenta color-forming layer, and the cyan color-forming layer may be composed of two or three layers. It is also preferable that a coupler-containing layer free from a silver halide emulsion be applied adjacent to a silver halide emulsion layer to form a coloring layer, as described in, for example, JP-A-4-75055, JP-A-9-114035, JP-A-10-246940, and U.S. Pat. No. 5,576,159.

The silver halide emulsion layer containing yellow coupler is preferably coated in the position further-most from a support than any other silver halide emulsion layers. The amount of a hydrophilic binder in the silver halide emulsion layer containing a yellow coupler and positioned further-most from a support according to the present invention, is preferably 1.35 g/m$^2$ or less, more preferably 1.25 g/m$^2$ or less, and most preferably in the range of 1.20 g/m$^2$ or less but 0.60 g/m$^2$ or more. Further, with respect to the thickness of a silver halide emulsion, when cubic grains are used, the side length of the grains is preferably 0.80 $\mu$m or less, more preferably 0.75 $\mu$m or less, and most preferably 0.70 $\mu$m to 0.30 $\mu$m. When tabular grains are used, the side length of the grains is preferably in the range of 0.40 $\mu$m to 0.02 $\mu$m, more preferably 0.30 $\mu$m or less, further preferably 0.20 $\mu$m or less, and most preferably in the range of 0.15 $\mu$m to 0.05 $\mu$m. The aspect ratio of the tabular grains is preferably in the range of 2 to 10, and more preferably in the range of 3 to 8. Further, two or more kinds of silver halide emulsions having a different grain size and/or grain shape from each other are preferably used in mixture, in order to control photographic speed, gradation, and other photographic properties.

A coating amount of the silver halide emulsion for use in the present invention is preferably 0.60 g/m$^2$ or less but 0.10 g/m$^2$ or more, more preferably it is in the range of 0.55 g/m$^2$ to 0.20 g/m$^2$, and most preferably in the range of 0.50 g/m$^2$ to 0.25 g/m$^2$.

When cubic silver halide emulsion grains are used in a cyan color-forming layer and a magenta color-forming layer, the side length of the cubic grains is preferably 0.50 $\mu$m or less, and preferably it is in the range of 0.40 $\mu$m to 0.10 $\mu$m.

The term "film thickness of the photographic constituent layers" in the present invention means a total thickness of photographic constituent layers above a support before processing. Specifically, the thickness can be measured by any one of the following methods. First, a silver halide color photographic light-sensitive material is cut at right angles to a support, and the resultant cut section is measured using an electron microscope. The second method is a method in which a film thickness can be calculated based on both a total coating amount (g/m$^2$) of ingredients in the photographic constituent layers and specific gravity of each of the ingredients.

For example, specific gravity of a typical gelatin for use in photography is 1.34 g/ml, and that of silver chloride grains is 5.59 g/ml. Specific gravity of each of other oleophilic additives can also be measured. Consequently a film thickness can be calculated according to the second method.

A film thickness of the photographic constituent layers in the present invention is preferably 9.0 $\mu$m or less, more preferably 8.0 $\mu$m or less, and most preferably in the range of 7.0 $\mu$m to 3.5 $\mu$m.

In the present invention, the term "hydrophobic photographic raw materials" means oil-soluble materials except for color-forming couplers. The term "oil-soluble materials" referred to in the present invention, means lipophilic ingredients remaining in a processed light-sensitive material. Specific examples of the ingredients include a color-forming coupler, a high-boiling organic solvent, a color-mixing inhibitor, an ultraviolet absorber, lipophilic additives, a lipophilic polymer or polymer latex, a matte agent, and a sliding (slipping) agent. In other words, such ingredients are those usually added into the photographic constituent layers as a lipophilic fine particle. Accordingly, a water-soluble dyestuff, a hardening agent, water-soluble additives, a silver halide emulsion, and the like do not fall under the definition of the oil-soluble material. Further, a surface-active agent is usually used, when such lipophilic fine particles are prepared. However, the surface-active agent is not dealt with as the oil-soluble material in the present invention.

The total amount of the oil-soluble material in the present invention is preferably 4.5 g/m$^2$ or less, more preferably 4.0 g/m$^2$ or less, and most preferably in the range of 3.8 g/m$^2$ to 3.0 g/m$^2$. In the present invention, the value obtained by dividing the weight amount (g/m$^2$) of hydrophobic photographic raw materials incorporated in a layer containing a dye-forming coupler, by the weight amount (g/m$^2$) of the dye-forming coupler, is preferably 4.5 or less, more preferably 3.5 or less, and most preferably 3.0 or less.

The ratio of the amount of oil-soluble materials to the amount of a hydrophilic binder in the photographic constituent layers may be optionally determined, in the present invention. A weight ratio for the photographic constituent layers except for a protective layer is preferably in the range of 0.05 to 1.50, more preferably in the range of 0.10 to 1.40, and most preferably in the range of 0.20 to 1.30. Optimization of the ratio for each of the layers allows a film strength, a scratch resistance, and curl characteristics to be adjusted.

As to a silver halide emulsion, which can be used in the color photographic light-sensitive material of the present invention, the silver halide emulsion of the present invention is incorporated in at least one of the silver halide emulsion layers. Preferably, the silver halide emulsion of the present invention is used in the blue-sensitive emulsion layer of the silver halide emulsion layers. As other kinds of silver halide that can be used in the color photographic light-sensitive material of the present invention, there can be used silver chloride, silver bromide, silver (iodo)chlorobromide, silver iodobromide, silver iodochloride, and so on. From an object of rapid processing in particular, it is preferable to use a high silver chloride emulsion having a silver chloride content of 90 mole % or more, further more preferably 95 mole % or more, and especially preferably 98 mole % or more. Further, the high-chloride silver halide emulsion preferably has a silver bromide-localized phase. Further, if tabular grains having {100} or {111} planes as principal planes are used, the ratio of [B/AgX] can be increased. As a result, advantages such as advances in both color developing speed and reduction in color mixing occurring at the time of processing are obtained.

In the light-sensitive material according to the present invention, in order to improve the sharpness or the like of images, preferably the hydrophilic colloid layer contains a dye that can be decolored by processing (an oxonol dye inter alia), as described in EP-A-0,337,490(A2), pages 27 to 76, so that the optical reflection density of the light-sensitive material at 680 nm may be 0.70 or more, or preferably the water-resistant resin layer of the base contains 12% by weight or more (more preferably 14% by weight or more) of titanium oxide whose surface has been treated with a bivalent to tetravalent alcohol (e.g. trimethylolethane).

For the silver halide photographic light-sensitive material of the present invention, conventionally known photographic raw materials and additives can be used.

For example, as the photographic base, a transmission-type base or a reflective-type base can be used. As the transmission-type base, a transparent film, such as a cellulose nitrate film and a polyethylene terephthalate film, and one wherein a film, for example, of a polyester of 2,6-naphthalenedicarboxylic acid (NDCA) with ethylene glycol (EG), or a polyester of NDCA, terephthalic acid, and EG, is provided with an information recording layer, such as a magnetic layer, are preferably used. As a reflective-type base, particularly, a reflective-type base, wherein a laminate has a plurality of polyethylene layers or polyester layers and wherein at least one of such water-resistant resin layers (laminated layers) contains a white pigment, such as titanium oxide, is preferable.

Further, preferably the above water-resistant resin layers contain a fluorescent whitening agent. Further, a fluorescent whitening agent may be dispersed in the hydrophilic colloid layer of the light-sensitive material. As the fluorescent whitening agent, preferably a benzoxazole-series fluorescent whitening agent, a cumarin-series fluorescent whitening agent, or a pyrazoline-series fluorescent whitening agent can be used, and more preferably a benzoxazolylnaphthalene-series fluorescent whitening agent or a benzoxazolylstilbene-series fluorescent whitening agent is used. The amount to be used is not particularly limited, but preferably it is 1 to 100 mg/m$^2$. When it is mixed with a water-resistant resin, preferably the mixing proportion is 0.0005 to 3% by weight, and more preferably 0.001 to 0.5% by weight, to the resin.

The reflective-type base may be one wherein a hydrophilic colloid layer containing a white pigment is applied on a transparent-type base or a reflective-type base described in the above.

Further, the reflective-type base may be a base having a specular reflective- or a second-type diffusion reflective metal surface.

For the above reflective-type base, silver halide emulsions, as well as different metal ion species to be doped into silver halide grains, antifoggants or storage stabilizers of silver halide emulsions, chemical sensitizing methods (sensitizers), and spectrally sensitizing methods (spectral sensitizers) for silver halide emulsions, cyan, magenta, and yellow couplers and methods for emulsifying and dispersing the couplers, dye-image-preservability improving agents (antistaining agents and anti-fading agents), dyes (colored layers), gelatins, layer structures of light-sensitive materials, the pH of coatings of light-sensitive materials, and the like, those described in the patents shown in the following Table 1 can be preferably applied in the present invention.

TABLE 1

| Element | JP-A-7-104448 | JP-A-7-77775 | JP-A-7-301895 |
|---|---|---|---|
| Reflective type bases | Column 7, line 12 to Column 12, line 19 | Column 35, line 43 to Column 44, line 1 | Column 5, line 40 to Column 9, line 26 |
| Silver halide emulsions | Column 72, line 29 to Column 74, line 18 | Column 44, line 36 to Column 46, line 29 | Column 77, line 48 to Column 80, line 28 |
| Different metal ion species | Column 74, lines 19 to 44 | Column 46, line 30 to Column 47, line 5 | Column 80, line 29 to Column 81, line 6 |
| Storage stabilizers or antifoggants | Column 75, lines 9 to 18 | Column 47, lines 20 to 29 | Column 18, line 11 to Column 31, line 37 (Especially, mercaptoheterocyclic compounds) |
| Chemical sensitizing methods (Chemical sensitizers) | Column 74, line 45 to Column 75, line 6 | Column 47, lines 7 to 17 | Column 81, lines 9 to 17 |
| Spectrally sensitizing methods (Spectral sensitizers) | Column 75, line 19 to Column 76, line 45 | Column 47, line 30 to Column 49, line 6 | Column 81, line 21 to Column 82, line 48 |
| Cyan couplers | Column 12, line 20 to Column 39, line 49 | Column 62, lines 50 to 16 | Column 88, line 49 to Column 89, line 16 |
| Yellow couplers | Column 87, line 40 to Column 88, line 3 | Column 63, lines 17 to 30 | Column 89, lines 17 to 30 |
| Magenta couplers | Column 88, lines 4 to 18 | Column 63, line 3 to Column 64, line 11 | Column 31, line 34 to Column 77, line 44 and column 88, lines 32 to 46 |
| Emulsifying and dispersing methods of couplers | Column 71, line 3 to Column 72, line 11 | Column 61, lines 36 to 49 | Column 87, lines 35 to 48 |
| Dye-image-preservability improving agents (antistaining agents) | Column 39, line 50 to Column 70, line 9 | Column 61, line 50 to Column 62, line 49 | Column 87, line 49 to Column 88, line 48 |
| Anti-fading agents | Column 70, line 10 to Column 71, line 2 | | |
| Dyes (colored layers) | Column 77, line 42 to Column 78, line 41 | Column 7, line 14 to Column 19, line 42, and Column 50, line 3 to Column 51, line 14 | Column 9, line 27 to Column 18, line 10 |
| Gelatins | Column 78, lines 42 to 48 | Column 51, lines 15 to 20 | Column 83, lines 13 to 19 |
| Layer construction of light-sensitive materials | Column 39, lines 11 to 26 | Column 44, lines 2 to 35 | Column 31, line 38 to Column 32, line 33 |

TABLE 1-continued

| Element | JP-A-7-104448 | JP-A-7-77775 | JP-A-7-301895 |
|---|---|---|---|
| pH of coatings of light-sensitive material | Column 72, lines 12 to 28 | | |
| Scanning exposure | Column 76, line 6 to Column 77, line 41 | Column 49, line 7 to Column 50, line 2 | Column 82, line 49 to Column 83, line 12 |
| Preservatives in developing solution | Column 88, line 19 to Column 89, line 22 | | |

As the cyan, magenta, and yellow couplers that can be used or additionally used in the present invention, in addition to those described in the above Table, couplers described, for example, in JP-A-62-215272, page 91, upper right column, line 4 to page 121, upper left column, line 6; JP-A-2-33144, page 3, upper right column, line 14 to page 18, upper left column, the last line, and page 30, upper right column, line 6 to page 35, lower right column, line 11; and EP-A-355 660 (A2), page 4, line 15 to line 27, page 5, line 30 to page 28, the last line, page 45, line 29 to line 31, and page 47, line 23 to page 63, line 50; JP-A-8-122984, and JP-A-9-222704 are also useful. Further, as a cyan coupler, a pyrrolotriazole type coupler is preferably used. More specifically, examples are couplers represented by formula (I) or (II) of the above-mentioned JP-A-5-313324, and couplers represented by formula (I) of the above-mentioned JP-A-6-347960, and specific couplers shown in these patents are particularly preferable.

Known color-mixing inhibitors can be used in the present invention. Of these compounds, preferred are those described in the following patents.

For example, the use can be made of high molecular redox compounds described in JP-A-5-333501; phenidone and hydrazine-series compounds described in, for example, Japanese Patent Application No. 9-140719, and U.S. Pat. No. 4,923,787; and white couplers described in, for example, JP-A-5-249637, JP-A-10-282615, and German Patent No. 19,629,142A1. Particularly, in order to increase the pH of a developing solution and to enable a rapid development, it is also preferred to use redox compounds described in German Patent No. 19,618,786A1, German Patent No. 19806846A1, European Patent No. 0 839 623 A1, European Patent No. 0 842 975 A1, and French Patent No. 2760460A1.

In the present invention, it is preferred to use an ultraviolet ray absorbing agent having a high molar extinction coefficient. For example, compounds having a triazine nucleus can be mentioned, and preferably use can be made of the compounds described in the following patents: JP-A-46-3335, JP-A-55-152776, JP-A-5-197074, JP-A-5-232630, JP-A-5-307232, JP-A-6-211813, JP-A-8-53427, JP-A-8-234364, JP-A-8-239368, JP-A-9-31067, JP-A-10-115898, JP-A-10-147577, JP-A-10-182621, JP-T-8-501291 ("JP-T" means a published searched patent publication), European Patent No. 0 711 804 A, and German Patent No. 19739797A.

As fungiproofing/mildewproofing agents that can be used in the present invention, those described in JP-A-63-271247 are useful. As a hydrophilic colloid used in photographic layers that constitute the light-sensitive material, gelatin is preferable, and in particular, heavy metals contained as impurities, such as iron, copper, zinc, and manganese are preferably 5 ppm or less, and more preferably 3 ppm or less.

Further, an amount of calcium to be incorporated in a light-sensitive material is preferably 20 mg/m$^2$ or less, more preferably 10 mg/m$^2$ or less, and most preferably 5 mg/m$^2$ or less.

The light-sensitive material for use in the present invention is used in a usual printing system, in which a negative printer is used, and it is also suitable for a scanning exposure system, in which a cathode ray (CRT) is used.

In comparison with apparatuses using lasers, cathode ray tube exposure apparatuses are simple and compact and make the cost low. Further, the adjustment of optical axes and colors is easy.

For the cathode ray tubes used for image exposure, use is made of various emitters that emit light in spectral regions as required. For example, any one of, or a mixture of two or more of, a red-color emitter, a green-color emitter, and a blue-color emitter may be used. The spectral region is not limited to the above red, green, and blue, and a fluorescent substance that emits a color in the yellow, orange, purple, or infrared region may also be used. In particular, a cathode ray tube that emits white light by mixing these emitters is often used.

When the light-sensitive material has plural light-sensitive layers different in spectral sensitivity distributions, and the cathode ray tube has fluorescent substances that show light emission in plural spectral regions, plural colors may be exposed at a time; namely, image signals of plural colors are inputted into the cathode ray tube, to emit lights from the tube surface. A method in which exposure is made in such a manner that image signals for respective colors are inputted successively, to emit the respective colors successively, and they are passed through filters (films) for cutting out other colors (surface-successive exposure), may be employed, and generally the surface-successive exposure is preferred to make image quality high, since a high-resolution cathode ray tube can be used.

The light-sensitive material for use in the present invention is preferably used for digital scanning exposure system that uses monochromatic high-density light, such as a second harmonic generating light source (SHG) that comprises a combination of a nonlinear optical crystal with a semiconductor laser or a solid state laser using a semiconductor laser as an excitation light source, a gas laser, a light-emitting diode, or a semiconductor laser. To make the system compact and inexpensive, it is preferable to use a semiconductor laser or a second harmonic generating light source (SHG) that comprises a combination of a nonlinear optical crystal with a semiconductor laser or a solid state laser. Particularly, to design an apparatus that is compact, inexpensive, long in life, and high in stability, the use of a semiconductor laser is preferable, and desired is the use of a semiconductor laser in at least one exposure light source.

If such a scanning exposure light source is used, the spectral sensitivity maximum of the light-sensitive material for use in the present invention can arbitrarily be set by the wavelength of the light source for the scanning exposure to be used. In an SHG light source obtained by combining a nonlinear optical crystal with a semiconductor laser or a solid state laser that uses a semiconductor laser as an excitation light source, since the emitting wavelength of the laser can be halved, blue light and green light can be obtained. Therefore, the spectral sensitivity maximum of the light-sensitive material can be present in each of the usual three regions, the blue region, the green region, and the red region.

If the exposure time is defined as the time for which a picture element size is exposed to light with the density of the picture element being 400 dpi, preferably the exposure time is $10^{-4}$ sec or less, more preferably $10^{-6}$ sec or less.

Preferable scanning exposure systems that can be applied to the present invention are described in detail in the patents listed in the above Tables.

Further, to process the light-sensitive material of the present invention, processing materials and processing methods described in JP-A-2-207250, page 26, lower right column, line 1, to page 34, upper right column, line 9, and in JP-A-4-97355, page 5, upper left column, line 17, to page 18, lower right column, line 20, are preferably applied. Further, as the preservative used for this developing solution, compounds described in the patents listed in the above Tables are preferably used.

As the systems for developing the light-sensitive material of the present invention after the exposure thereof, a wet system, such as the conventional method, in which development is carried out by using a developing solution containing an alkali agent and a developing agent, and a method in which a developing agent is built in the light-sensitive material and the development is carried out by using an activator solution, such as an alkali solution, free from any developing agent, as well as a heat development system that does not use a processing solution, can be used. Particularly, since the activator method does not contain a developing agent in the processing solution, the control and the handling of the processing solution are easy, and the load at the time of waste liquor treatment is less, which makes the activator method preferable in view of environmental conservation.

In the activator method, as the developing agent or its precursor to be built in the light-sensitive material, hydrazine-type compounds described, for example, in JP-A-8-234388, 9-152686, 9-152693, Japanese Patent Application No. 7-334197, and JP-A-9-160193 are preferable.

Further, a development method in which the coated amount of silver in the light-sensitive material is decreased, and an image intensification processing (intensification processing) is carried out using hydrogen peroxide, is also preferably used. Particularly, it is preferable to use this method for the activator method. Specifically, preferably use is made of image-forming methods described in JP-A-8-297354 and JP-A-9-152695, wherein an activator solution containing hydrogen peroxide is used.

Although, in the activator method, after the processing with an activator solution, a desilvering process is generally carried out, in the image intensifying process in which a light-sensitive material with the amount of silver lowered is used, the desilvering process can be omitted, and a simple process, such as a washing process or a stabilizing process, can be carried out. Further, in a system in which image information is read from a light-sensitive material by a scanner or the like, a processing mode without requiring a desilvering process can be employed, even when a light-sensitive material having a large amount of silver, such as a light-sensitive material for shooting (photographing), is used.

As the activator solution, the desilvering solution (bleach/fix solution), the processing material of washing and stabilizing solution, and the processing method that are used in the present invention, known ones can be used. Preferably, those described in Research Disclosure Item 36544 (September 1994), pages 536 to 541, and JP-A-8-234388, can be used.

In the present invention, the term "color-developing time" means a period of time required from the beginning of dipping of a light-sensitive material into a color developing solution until the light-sensitive material is dipped into a blix solution in the subsequent processing step. In the case where a processing is carried out using, for example, an autoprocessor, the color developing time is the sum total of a time in which a light-sensitive material has been dipped in a color developing solution (so-called "time in the solution") and a time in which the light-sensitive material after departure from the color developing solution has been conveyed in the air toward a bleach-fixing bath in the step subsequent to color development (so-called "time in the air"). Similarly the term "bleach-fixing time" means a period of time required from the beginning of dipping of a light-sensitive material into a bleach-fixing solution until the light-sensitive material is dipped into a washing or stabilizing bath in the subsequent processing step. Further, the term "washing or stabilizing time" means a period of time in which a light-sensitive material is staying in the washing or stabilizing solution until it begins to be conveyed toward a drying step (so-called "time in the solution").

In the rapid processing which is an object of the present invention to be achieved, the color developing time is preferably 30 seconds or less, more preferably 20 seconds or less, and most preferably in the range of 15 seconds to 6 seconds. Similarly the bleach-fixing time is preferably 30 seconds or less, more preferably 20 seconds or less, and most preferably in the range of 15 seconds to 6 seconds. Further, the washing or stabilizing time is preferably 40 seconds or less, more preferably 30 seconds or less, and most preferably in the range of 20 seconds to 6 seconds.

A drying in the present invention is effected by any one of previously known methods of rapidly drying a color photographic light-sensitive material. It is preferable, from the object of the present invention, to dry a color photographic light-sensitive material within 20 sec., more preferably within 15 minutes, most preferably in the range of 5 sec. to 10 sec.

The drying system may be a contact heating system or a warm air spray system, but a combination of these systems is preferred because higher speed drying can be performed by such combined system, in comparison with any one of these systems. More preferable embodiment of the present invention with respective to a drying method is a system of heating a light-sensitive material by contact on a heat roller, and thereafter drying the light-sensitive material by blast of a warm air blown out thereto from a perforated plate or nozzles. At the air blast drying portion, the mass velocity of a warm air sprayed per unit area of the heating surface of the light-sensitive material is preferably 1000 $kg/cm^2 \cdot hr$ or more. Further, it is preferable that the shape of an air blast opening be a shape which minimizes pressure loss, and as specific examples of the shape of an air blast opening, those shown in, for example, JP-A-9-33998, FIG. 7 to FIG. 15 can be mentioned.

The light-sensitive material of the present invention exerts both rapid processing characteristics and a high sensitivity, and produces a low level of a pressure-induced fog, and further has a suitability for not only a face exposure but also a scanning exposure to high illumination intensity light in particular, and therefore an excellent image can be obtained in the above-described developing time.

The emulsions of the present invention are excellent in grain shape stability, and they are a monodisperse high speed and hard gradation emulsion, and moreover they are able to concurrently improve both high illumination intensity reciprocity law failure and latent image stability after exposure to light. The color photographic light-sensitive material of the present invention comprising the above-said emulsion has the foregoing characteristics, and further they are able to maintain these characteristics, even though they are subjected to exposure such as a scanning exposure (especially short time scanning exposure) and a rapid processing. Further, the present invention provides an image formation method, which is able to exert the foregoing excellent characteristics of the emulsions or light-sensitive materials, even upon a scanning exposure.

The present invention will be described in more detail with reference to examples, but the present invention is not restricted to them.

EXAMPLES

Example 1

(Preparation of Comparison Emulsion A)

2.0 g of sodium chloride and 2.8 g of inert gelatin were added to a container containing 1.2 l of water. To the resultant container maintained at the temperature of 33° C., 60 cc of an aqueous solution of silver nitrate (containing 9 g of silver nitrate) and 60 cc of an aqueous solution of sodium chloride (containing 3.2 g of sodium chloride) were added, with stirring, over one minute according to a double jet method. One minute after the completion of the addition, 1 mmol of Crystal habit controlling agent was added. Further one minute later, 3.0 g of sodium chloride was added. During the next 25 minutes, the temperature of the container was increased to 60° C. After a ripening of 16 minutes at 60° C., 290 g of an aqueous solution of 10% phthalated gelatin and 0.8 mmol of Crystal habit controlling agent 1 were added. Thereafter, 754 ml of an aqueous solution of silver nitrate (containing 113 g of silver nitrate) and 768 ml of an aqueous solution of sodium chloride (containing 41.3 g of sodium chloride) were added at an accelerated flow rate, over 28 minutes. During the process, 30 ml of an aqueous solution of 0.25M sodium chloride (containing 0.48 g of potassium iodide, and 11 mg of potassium ferrocyanide) was added at the timing of from 21 minutes to 28 minutes. Further, $8\times10^{-4}$ mol of blue-sensitive spectrally sensitizing dye A, B, and C were added in total, and 12 g of sodium dodecylbenzenesulfonate (DBS) was added, and then left for 30 minutes after the temperature was elevated to 75° C.

Sensitizing dye A

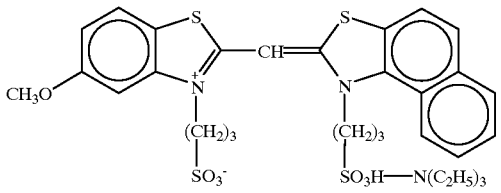

-continued

Sensitizing dye B

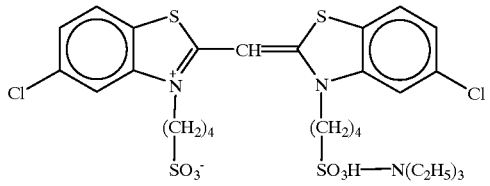

Sensitizing dye C

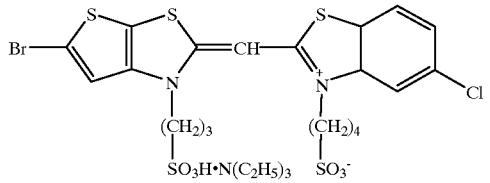

Crystal habit controlling agent 1

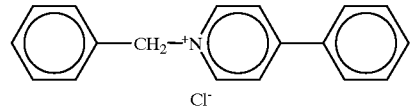

Flocculation washing was carried at 40° C. to complete a desalting. Further, 100 g of a lime-processed gelatin was added, and the pH value and the pAg value were adjusted to 6.2 and 7.0, respectively. Thereafter, a mixture solution of sodium thiosulfonate and sodium sulfinate ($4\times10^{-4}$ mol and $1\times10^{-4}$ mol, per mol of silver, respectively) was added, and the resultant emulsion was subjected to optimum chemical sensitization with chloroauric acid and 1-(3-methylureidophenyl)-5-mercaptotetrazole.

The electron photomicrograph showed that the shape of the obtained grains was tabular grains having {111} planes as principal planes, with the equivalent projected area diameter of 0.82 μm, the thickness of 0.13 μm, the aspect ratio of 6, the equivalent sphere diameter of 0.5 μm, (0.40 μm in the equivalent cube side length), and the coefficient of deviation of 0.25. (iodide content of 0.4 mol %)

Further, the proportion of grains, which were {111} tabular grains having the aspect ratio of 2 or more and the straight-line portion ratio of 0.8 or more (the proportion based on the total projected area, hereinafter simply referred to as "proportion"), was 30.5% of the total grains.

(Preparation of Comparative Emulsion B)

The same preparation procedure as Emulsion A was repeated till before addition of the blue-sensitive spectral sensitizing dye. Thereafter, the resultant emulsion was cooled to 30° C., and then a 8 mol % portion of silver nitrate aqueous solution and a 8 mol % portion of 2% potassium bromide aqueous solution were slowly added at the same time. After that, blue-sensitive spectral sensitizing dyes A, B, and C were added in the total amount of $8\times10^{-4}$ mol per mol of silver, 12 g of DBS was added, and then the temperature of the resultant emulsion was increased to 75° C. and the emulsion was allowed to stand for 30 minutes.

Both desalting and chemical sensitization were conducted in the same manner as Emulsion A.

The proportion of grains, which were {111} tabular grains having the aspect ratio of 2 or more and the straight-line portion ratio of 0.8 or more, was 6.1% of the total grains.

(Preparation of Emulsion C of the Invention)

The addition of a silver nitrate aqueous solution and a potassium bromide aqueous solution was conducted at 75°

C. in place of 30° C. in the preparation of Emulsion B. The other procedures were carried out in the same manner as Emulsion B, until the completion of chemical sensitization.

The electron photomicrograph showed that the shape of the obtained grains was tabular grains having {111} planes as principal planes, with the equivalent projected area diameter of 0.82 μm, the thickness of 0.13 μm, the aspect ratio of 6, the equivalent sphere diameter of 0.50 μm, (0.40 μm in the equivalent cube side length), and the coefficient of deviation of 0.25. (iodide content of 0.4 mol %)

Further, the proportion of grains, which were {111} tabular grains having the aspect ratio of 2 or more, and the straight-line portion ratio of 0.8 or more, was 68.4% of the total grains.

Figure 2:
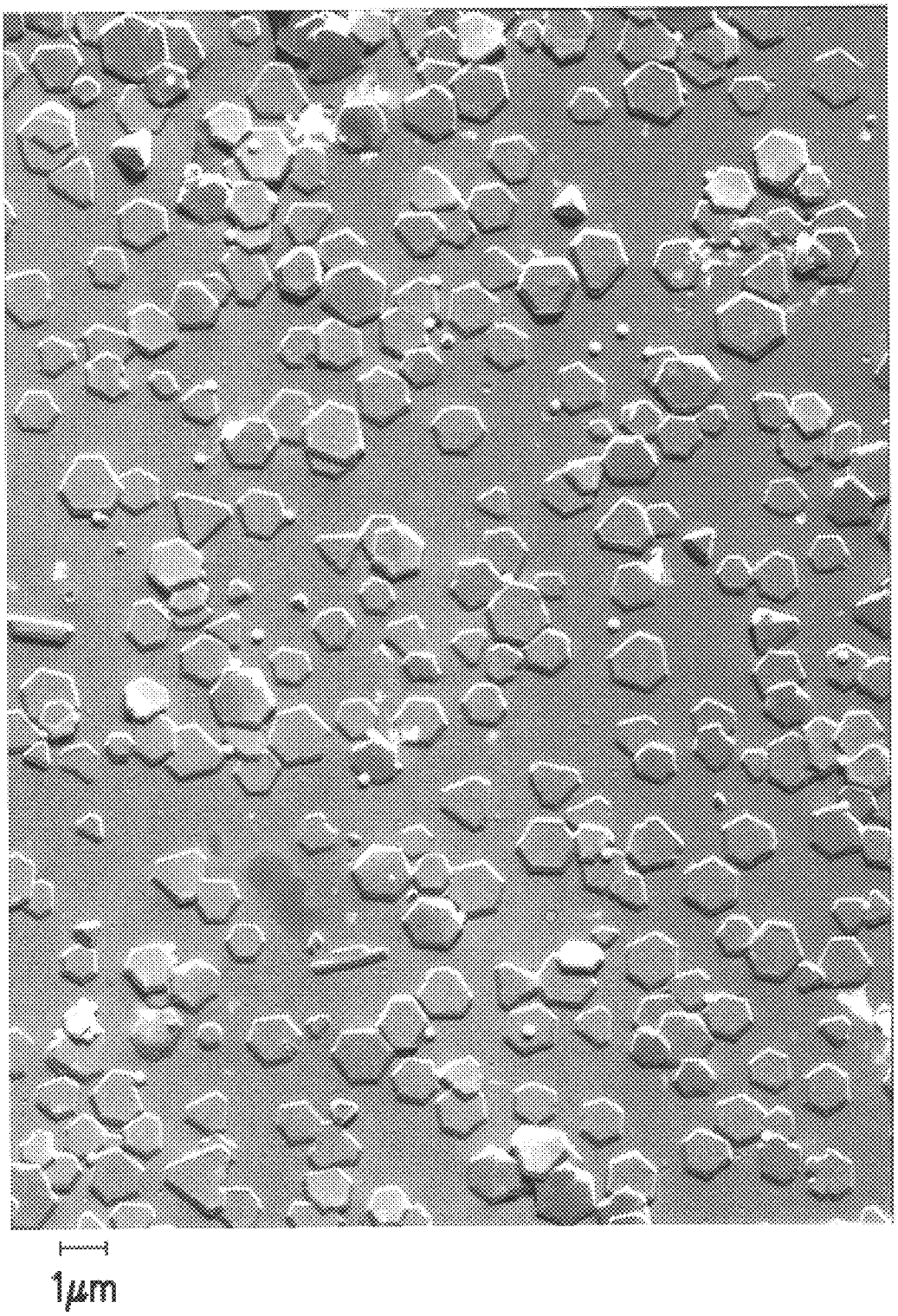
FIG. 2 is an electron photomicrograph of Emulsion C prepared in Example 1, taken after both spectral and chemical sensitizations.
Figure 4:
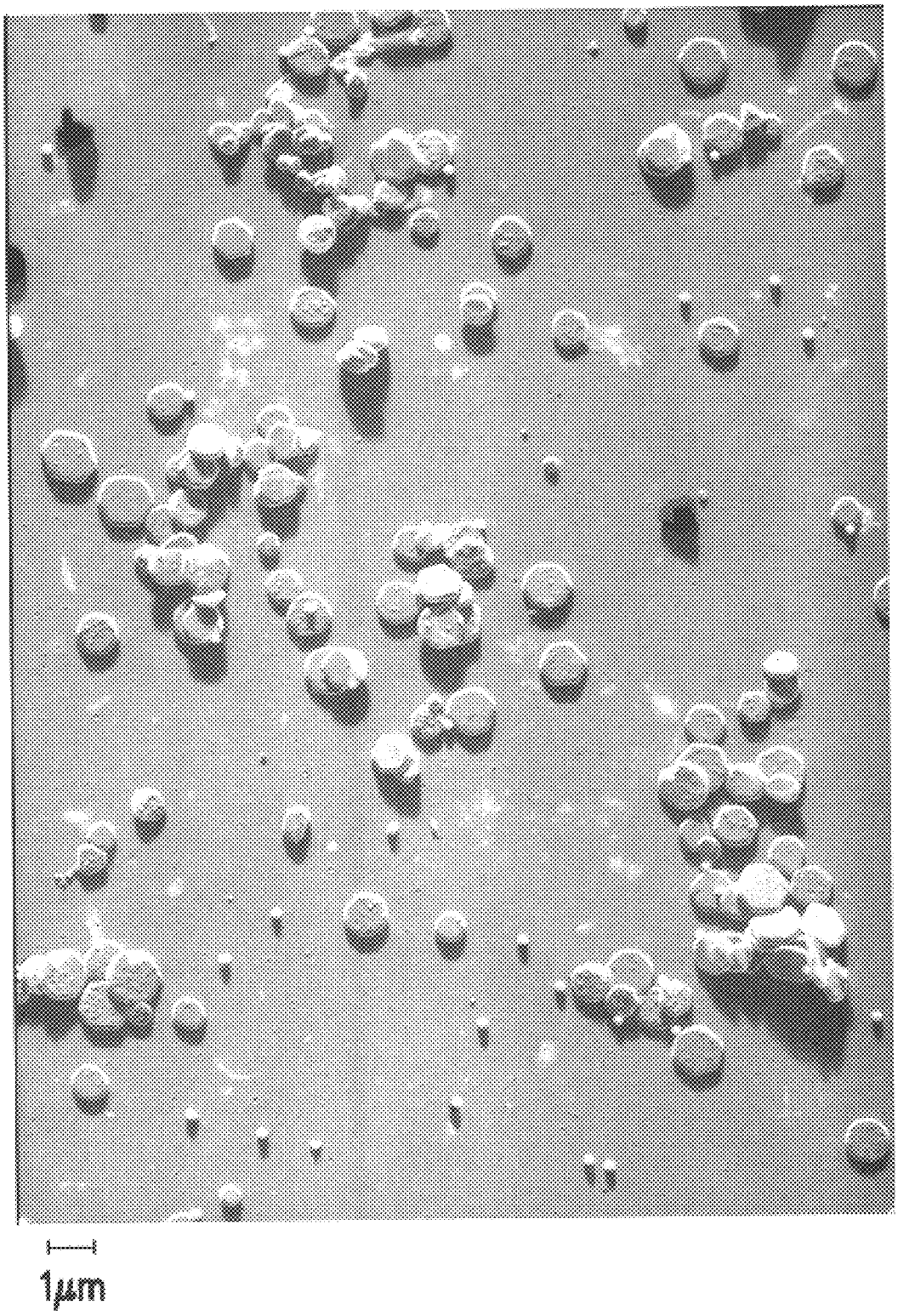
FIG. 4 is an electron photomicrograph of comparative emulsion A prepared in Example 1, taken after both spectral and chemical sensitizations.
Figure 5:
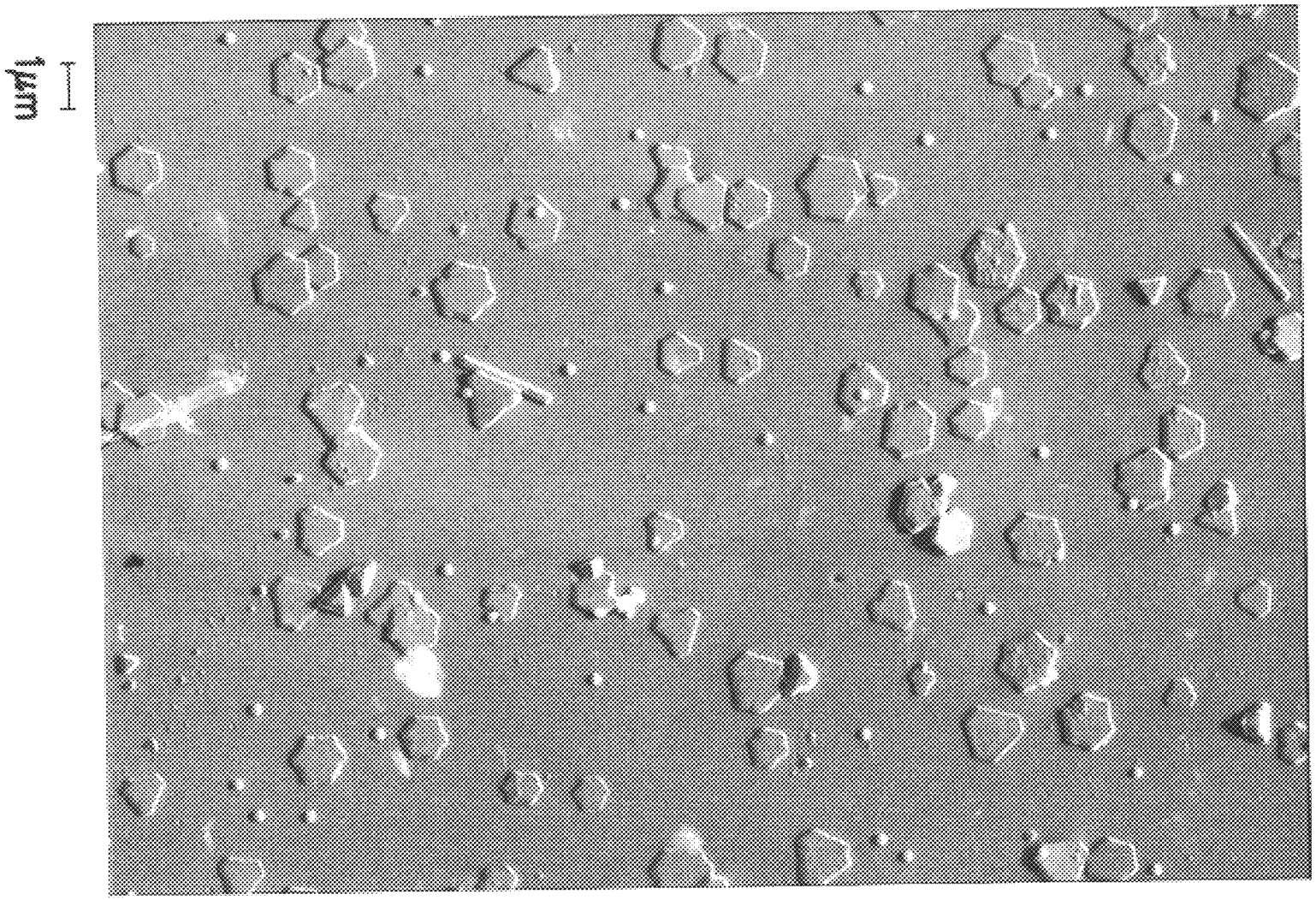
FIG. 5 is an electron photomicrograph of comparative emulsion B prepared in Example 1, taken after both spectral and chemical sensitizations.

An electron photomicrograph (replica) of the spectrally and chemically sensitized Emulsion C is shown in FIG. 2. Electron photomicrographs (replica) of the spectrally and chemically sensitized comparative emulsions A and B are shown in FIG. 4 and FIG. 5, respectively.

Further, variation in the maximum absorption wavelength accompanied by the adsorption of dyes before and after chemical sensitization of each of the emulsions, are shown in Table 3.

TABLE 3

| Emulsion | Br Content | Maximum absorption wavelength before chemical sensitization | Maximum absorption wavelength after chemical sensitization | Length of wave-length shift | Remarks |
|---|---|---|---|---|---|
| Emulsion A | none | 460 nm | 480 nm | 20 nm | Comparative example |
| Emulsion B | 8 mol % | 460 nm | 477 nm | 17 nm | Comparative example |
| Emulsion C | 8 mol % | 460 nm | 460 nm | 0 nm | This invention |

With respect to Emulsion A, even before chemical sensitization, some of rounded {111} tabular grains were observed. What is more, after chemical sensitization, the number of the rounded grains was considerably increased. Further, maximum absorption wavelength markedly shifted between before and after chemical sensitization.

With respect to Emulsion B, even before chemical sensitization, the grains were rounded by an epitaxial growth. After chemical sensitization, the grains got out of their shape. Further, the maximum absorption wavelength also shifted.

On the other hand, with respect to Emulsion C, even before chemical sensitization, epitaxial growth was not observed, and grains were angular compared with those of Emulsion A. Further, the grain shape was maintained even after chemical sensitization, and the maximum absorption wavelength did not shift. It was found that grains of Emulsion C had a band-like continuous phase of silver bromide deposited on the outermost layer of the grains.

It was found that by having silver bromide deposited on the grains so that the resulting grains did not cause rounded-corners, it is possible not only stabilizing the grain shape, but also fixing the maximum absorption wavelength that influences on the photographic characteristics.

As results of measurement of the X ray diffraction of Emulsions B and C, a Br-comprising region having the Br content of 20% existed in the grains of Emulsion B, and a high Br-comprising region having the Br content of 50% existed in the grains of Emulsion C. Namely, it was found that it was difficult to steadily obtain a high Br-comprising region in epitaxial grains.

Example 2

(Preparation of Emulsion D)

Emulsion D was prepared in the same manner as Emulsion B, except that the addition of a silver nitrate aqueous solution and a potassium bromide aqueous solution which was conducted at 30° C., was repeated in the amount of each of 1 mol % portion in place of each of 8 mol % potions, and after having finished 75% of the addition, an aqueous solution of potassium hexachloroiridate (IV) was added in an amount of $1\times10^{-7}$ mol per mol of the total silver amount. The other procedures were conducted in the same manner as in Emulsion B.

The proportion of {111} tabular grains having an aspect ratio of 2 or more, and a straight-line portion ratio of 0.8 or more, was 27.5% of the total grains.

(Preparation of Emulsion E)

Emulsion E was prepared in the same manner as Emulsion C, except that the addition of a silver nitrate aqueous solution and a potassium bromide aqueous solution which was conducted at 75° C., was repeated in the amount of each of 1 mol % portion in place of each of 8 mol % potions, and after having finished 75% of the addition, an aqueous solution of potassium hexachloroiridate (IV) was added in an amount of $3\times10^{-7}$ mol per mol of the total silver amount. The other procedures were conducted in the same manner as in Emulsion B.

The proportion of {111} tabular grains having an aspect ratio of 2 or more, and a straight-line portion ratio of 0.8 or more, was 93.5% of the total grains.

(Preparation of Emulsion F)

Figure 3:
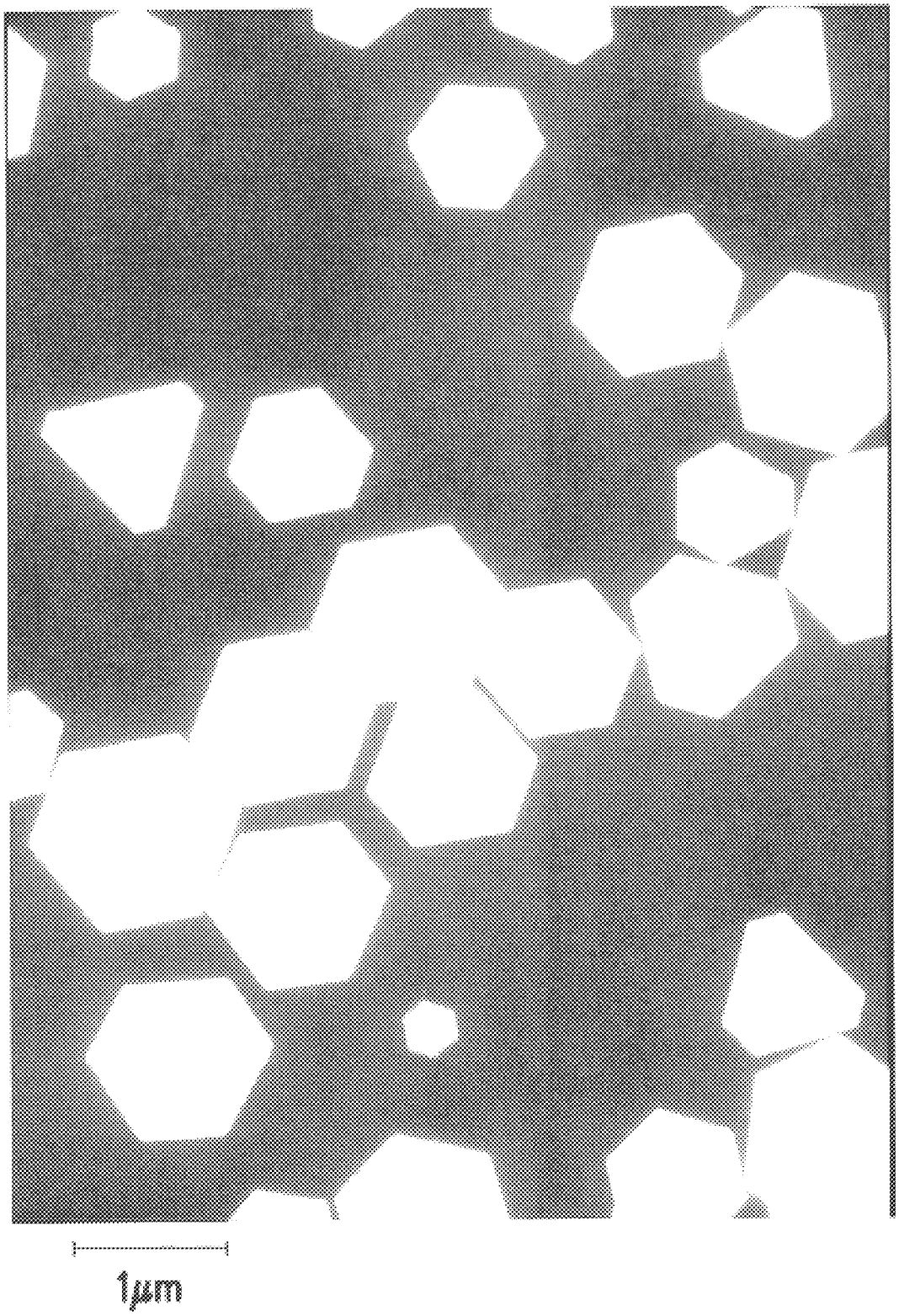
FIG. 3 is an electron photomicrograph of Emulsion F prepared in Example 2, taken after both spectral and chemical sensitizations.

Emulsion F was prepared in the same manner as Emulsion E, except that a 0.5 mol % portion of silver nitrate and a 0.5 mol % portion of potassium bromide were further added onto the outermost layer. The other procedures were conducted in the same manner as in Emulsion E. An electron photomicrograph (direct) of the spectrally and chemically sensitized emulsion F is shown in FIG. 3.

The proportion of {111} tabular grains having an aspect ratio of 2 or more, and a straight-line portion ratio of 0.8 or more, was 95.0% of the total grains.

(Preparation of Emulsion G)

Emulsion G was prepared in the same manner as Emulsion F, except that potassium thiocyanate was added in an amount of $2.8\times10^{-3}$ mol per mol of silver halide, just before addition of the sensitizing dye. The other procedures were conducted in the same manner as in Emulsion F to obtain Emulsion G.

The proportion of {111} tabular grains having an aspect ratio of 2 or more, and a straight-line portion ratio of 0.8 or more, was 90.5% of the total grains.

The electron photomicrographs showed that the grain shape of Emulsions E, F, and G were each tabular grains having {111} planes as principal planes. Further, the equivalent projected area diameter, the thickness, the aspect ratio, the equivalent sphere diameter, the value calculated in terms of the equivalent cube side length, and the coefficient of deviation were each the same as those of Emulsion C.

Further, in each of Emulsions E, F and G, the proportion of grains having a straight-line portion ratio of 0.95 or more, was about 90%.

According to photographs taken by a transmission type electron microscope, it was observed that, among these emulsions, grains in Emulsions E to G had silver bromide deposited in the form of a band-like continuous phase on the outermost layer.

A paper base both surfaces of which had been coated with a polyethylene resin, was subjected to surface corona discharge treatment; then it was provided with a gelatin undercoat layer containing sodium dodecylbenzenesulfonate, and it was successively coated with the first to seventh photographic constitutional layers, to prepare samples of a silver halide color photographic light-sensitive material sample (201) having the layer configuration shown below. The coating solutions for each photographic constitutional layer were prepared as follows. Preparation of First-Layer Coating Solution 57 g of a yellow coupler (ExY), 7 g of a color-image-stabilizer (Cpd-1), 4 g of a color-image-stabilizer (Cpd-2), 7 g of color-image-stabilizer (Cpd-3), and 2 g of a color-image-stabilizer (Cpd-8) were dissolved in 21 g of a solvent (Solv-1) and 80 ml of ethyl acetate, and the resulting solution was emulsified and dispersed in 220 g of a 23.5 wt % aqueous gelatin solution containing 4 g of sodium dodecylbenzenesulfonate, by means of a high speed agitation emulsifier (Dissolver), and water was added to prepare 900 g of emulsified dispersion A.

On the other hand, the above-described emulsified dispersion A and emulsion A were mixed and dissolved, and a first-layer coating solution was prepared using the resulting mixture solution so as to become the composition described below. The coating amount of the emulsion is in terms of silver.

The coating solutions for the second layer to seventh layer were prepared in the similar manner as that for the first layer coating solution. As the gelatin hardener for each layer, 1-oxy-3,5-dichloro-s-triazine sodium salt (H-1), (H-2), and (H-3) were used. Further, to each layer, were added Ab-1, Ab-2, Ab-3, and Ab-4, so that the total amounts would be 15.0 mg/m$^2$, 60.0 mg/m$^2$, 5.0 mg/m$^2$, and 10.0 mg/m$^2$, respectively.

(H-1) Hardener

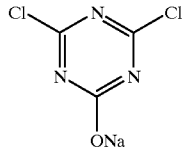

(used in 1.4 wt % per gelatin)

(H-2) Hardener

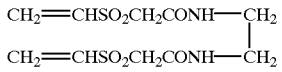

(H-3) Hardener

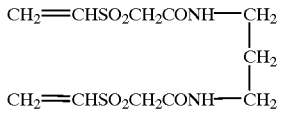

(Ab-1) Antiseptic

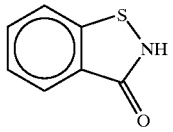

(Ab-2) Antiseptic

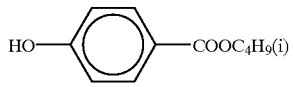

(Ab-3) Antiseptic

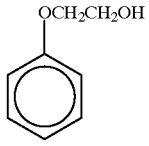

(Ab-4) Antiseptic

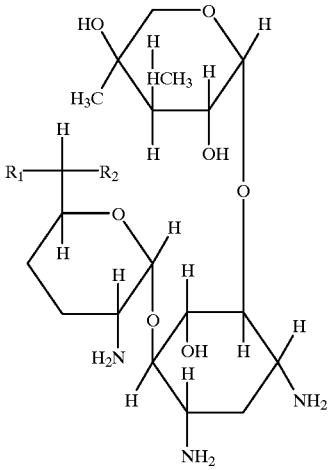

| | $R_1$ | $R_2$ |
|---|---|---|
| a | $-CH_3$ | $-NHCH_3$ |
| b | $-CH_3$ | $-NH_2$ |
| c | $-H$ | $-NH_2$ |
| d | $-H$ | $-NHCH_3$ |

A mixture of 1:1:1:1 (molar ratio) of a, b, c, d

For the silver chlorobromide emulsion of each of green- and red-sensitive emulsion layers, the following spectral sensitizing dyes were used, respectively.

Green-Sensitive Emulsion Layer (Sensitizing dye D)

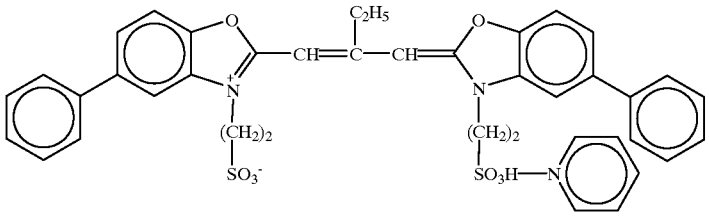

(Sensitizing dye E)

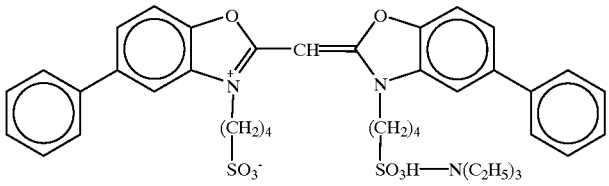

(Sensitizing dye F)

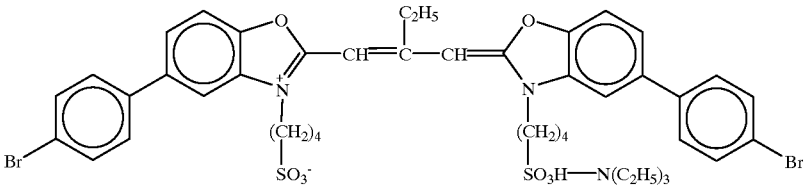

(The sensitizing dye D was added to the large-size emulsion in an amount of $3.0\times10^{-4}$ mol per mol of the silver halide, and to the small-size emulsion in an amount of $3.6\times10^{-4}$ mol per mol of the silver halide; the sensitizing dye E was added to the large-size emulsion in an amount of $4.0\times10^{-5}$ mol per mol of the silver halide, and to the small-size emulsion in an amount of $7.0\times10^{-5}$ mol per mol of the silver halide; and the sensitizing dye F was added to the large-size emulsion in an amount of $2.0\times10^{-4}$ mol per mol of the silver halide, and to the small-size emulsion in an amount of $2.8\times10^{-4}$ mol per mol of the silver halide.)

Red-Sensitive Emulsion Layer (Sensitizing dye G)

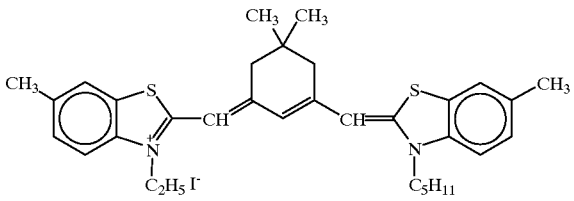

(Sensitizing dye H)

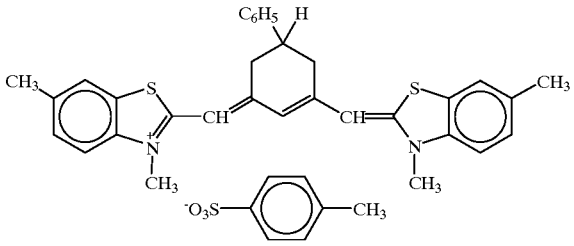

(The sensitizing dyes G and H were added, respectively, to the large-size emulsion, in an amount of $8.0\times10^{-5}$ mol per mol of the silver halide, and to the small-size emulsion in an amount of $10.7\times10^{-5}$ per mol of the silver halide.)

Further, the following Compound I was added to the red-sensitive emulsion layer, in an amount of $3.0\times10^{-3}$ mol per mol of the silver halide.

(Compound I)

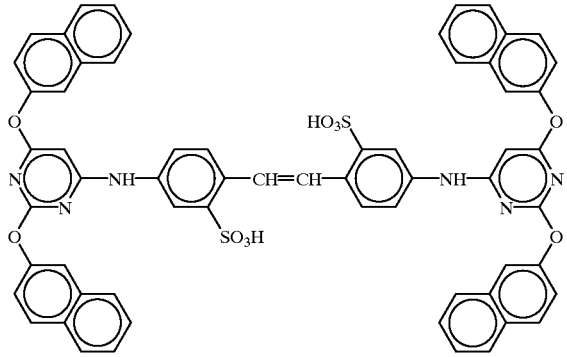

Further, to the blue-sensitive emulsion layer, the green-sensitive emulsion layer, and the red-sensitive emulsion layer, was added 1-(3-methylureidophenyl)-5-mercaptotetrazole in amounts of $3.3\times10^{-4}$ mol. $1.0\times10^{-3}$ mol, and $5.9\times10^{-4}$ mol. per mol of the silver halide, respectively.

Further, to the second layer, the fourth layer, the sixth layer, and the seventh layer, it was added in amounts of 0.2 mg/m$^2$, 0.2 mg/M$^2$, 0.6 mg/m$^2$, and 0.1 mg/m$^2$, respectively.

Further, to the blue-sensitive emulsion layer and the green-sensitive emulsion layer, was added 4-hydroxy-6-methyl-1,3,3a,7-tetrazaindene in amounts of $1\times10^{-4}$ mol and $2\times10^{-4}$ mol, respectively, per mol of the silver halide.

To the red-sensitive emulsion layer, was added a copolymer latex of methacrylic acid and butyl acrylate (1:1 in weight ratio; average molecular weight, 200,000 to 400,000) in an amount of 0.05 g/m$^2$.

Further, to the second layer, the fourth layer, and the sixth layer, was added disodium catechol-3,5-disulfonate in amounts of 6 mg/m$^2$, 6 mg/m$^2$, and 18 mg/m$^2$, respectively.

Further, to neutralize irradiation, the following dyes were added to the emulsion layers (the coating amount is shown in parentheses).

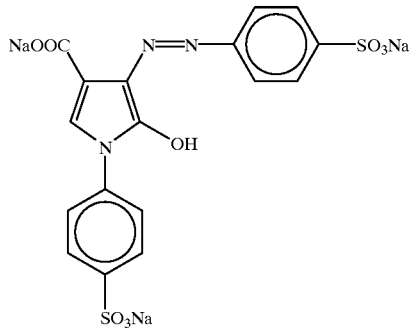

(2 mg/m$^2$)

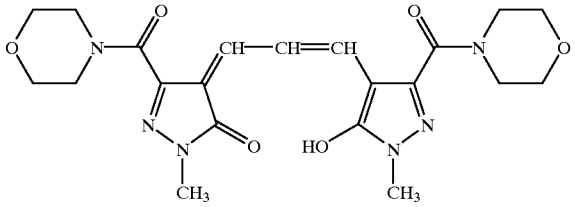

(2 mg/m$^2$)

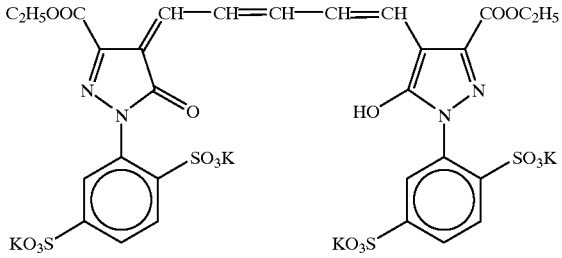

(3 mg/m$^2$)

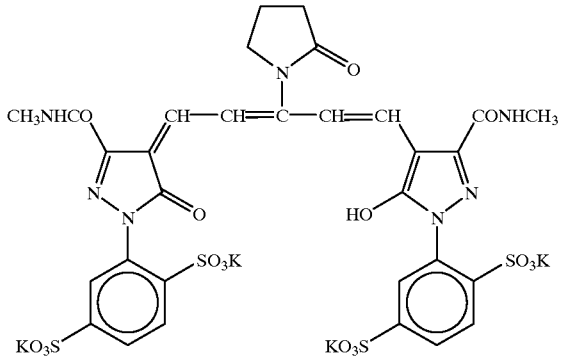

(7 mg/m$^2$)

(Layer Constitution)

The composition of each layer is shown below. The numbers show coating amounts (g/m$^2$). In the case of the silver halide emulsion, the coating amount is in terms of silver.

Base

Polyethylene Resin-Laminated Paper

[The polyethylene resin on the first layer side contained a white pigment ($TiO_2$: content of 16 wt %, ZnO: content of 4 wt %), a fluorescent whitening agent (4,4'-bis(5-methylbenzoxazoryl)stilbene: content of 0.03 wt %), and a blue dye (ultramarine)]

| | |
|---|---|
| First Layer (Blue-Sensitive Emulsion Layer) | |
| Emulsion A | 0.24 |
| Gelatin | 1.25 |
| Yellow coupler (ExY) | 0.57 |
| Color-image stabilizer (Cpd-1) | 0.07 |
| Color-image stabilizer (Cpd-2) | 0.04 |
| Color-image stabilizer (Cpd-3) | 0.07 |
| Color-image stabilizer (Cpd-8) | 0.02 |
| Solvent (Solv-1) | 0.21 |
| Second Layer (Color-Mixing Inhibiting Layer) | |
| Gelatin | 0.99 |
| Color-mixing inhibitor (Cpd-4) | 0.09 |
| Color-image stabilizer (Cpd-5) | 0.018 |
| Color-image stabilizer (Cpd-6) | 0.13 |
| Color image stabilizer (Cpd-7) | 0.01 |
| Solvent (Solv-1) | 0.06 |
| Solvent (Solv-2) | 0.22 |
| Third Layer (Green-Sensitive Emulsion Layer) | |
| A silver chlorobromide emulsion B (Cubes, a mixture of a large-size emulsion B having an average grain size of 0.45 μm, and a small-size emulsion B having an average grain size of 0.35 μm (1:3 in terms of mol of silver). The deviation coefficients of the grain size distributions were 0.10 and 0.08, respectively, and each emulsion had 0.4 mol % of a silver bromide locally contained in part of the grain surface whose substrate was made up of silver chloride.) | 0.14 |
| Gelatin | 1.36 |
| Magenta coupler (ExM) | 0.15 |
| Ultraviolet absorbing agent (UV-A) | 0.14 |
| Color-image stabilizer (Cpd-2) | 0.02 |
| Color-image stabilizer (Cpd-4) | 0.002 |
| Color-image stabilizer (Cpd-6) | 0.09 |
| Color-image stabilizer (Cpd-8) | 0.02 |
| Color-image stabilizer (Cpd-9) | 0.03 |
| Color-image stabilizer (Cpd-10) | 0.01 |
| Color-image stabilizer (Cpd-11) | 0.0001 |
| Solvent (Solv-3) | 0.11 |
| Solvent (Solv-4) | 0.22 |
| Solvent (Solv-5) | 0.20 |
| Fourth Layer (Color-Mixing Inhibiting Layer) | |
| Gelatin | 0.71 |
| Color-mixing inhibitor (Cpd-4) | 0.06 |
| Color-image stabilizer (Cpd-5) | 0.013 |
| Color-image stabilizer (Cpd-6) | 0.10 |
| Color-image stabilizer (Cpd-7) | 0.007 |
| Solvent (Solv-1) | 0.04 |
| Solvent (Solv-2) | 0.16 |
| Fifth Layer (Red-Sensitive Emulsion Layer) | |
| A silver chlorobromide emulsion C (Cubes, a mixture of a large-size emulsion C having an average grain size of 0.40 μm, and a small-size emulsion C having an average grain size of 0.30 μm (5:5 in terms of mol of silver). The deviation coefficients of the grain size distributions were 0.09 and 0.11, respectively, and each emulsion had 0.8 mol % of a silver bromide locally contained in part of the grain surface whose substrate was made up of silver chloride.) | 0.12 |
| Gelatin | 1.11 |
| Cyan coupler (ExC-2) | 0.13 |
| Cyan coupler (ExC-3) | 0.03 |
| Color-image stabilizer (Cpd-1) | 0.05 |
| Color-image stabilizer (Cpd-6) | 0.06 |
| Color-image stabilizer (Cpd-7) | 0.02 |
| Color-image stabilizer (Cpd-9) | 0.04 |
| Color-image stabilizer (Cpd-10) | 0.01 |
| Color-image stabilizer (Cpd-14) | 0.01 |
| Color-image stabilizer (Cpd-15) | 0.12 |
| Color-image stabilizer (Cpd-16) | 0.03 |
| Color-image stabilizer (Cpd-17) | 0.09 |
| Color-image stabilizer (Cpd-18) | 0.07 |
| Solvent (Solv-5) | 0.15 |
| Solvent (Solv-8) | 0.05 |

-continued

| Sixth Layer (Ultraviolet Absorbing Layer) | |
|---|---|
| Gelatin | 0.46 |
| Ultraviolet absorbing agent (UV-B) | 0.45 |
| Compound (S1-4) | 0.0015 |
| Solvent (Solv-7) | 0.25 |

-continued

| Seventh Layer (Protective Layer) | |
|---|---|
| Gelatin | 1.00 |
| Acryl-modified copolymer of polyvinyl alcohol (modification degree: 17%) | 0.04 |
| Liquid paraffin | 0.02 |
| Surface-active agent (Cpd-13) | 0.01 |

(ExY) Yellow coupler
A mixture of 70:30 (molar ratio) of

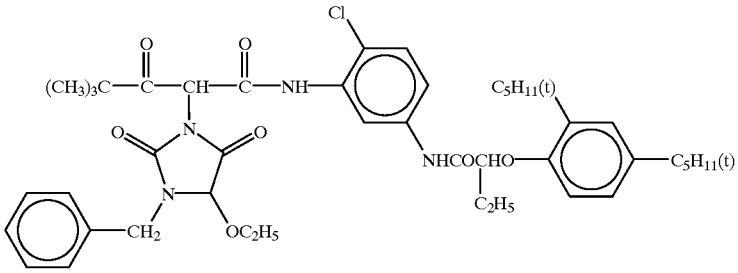

and

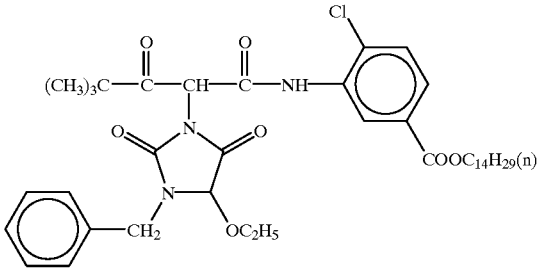

(ExM) Magenta coupler
A mixture of 40:40:20 (molar ratio) of

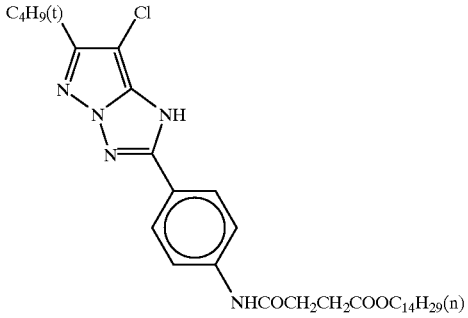

and

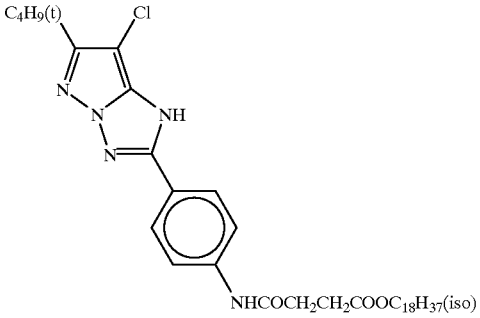

and

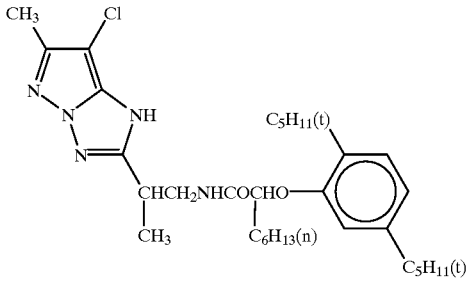

-continued
(ExC-2 Cyan coupler
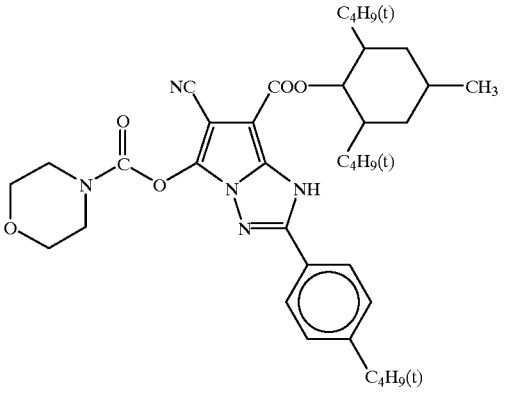
(ExC-3) Cyan coupler
A mixture of 50:25:25 (molar ratio) of
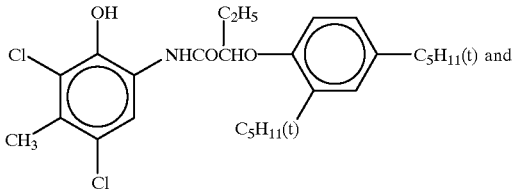
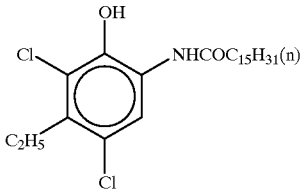
(Cpd-2) Color-image stabilizer
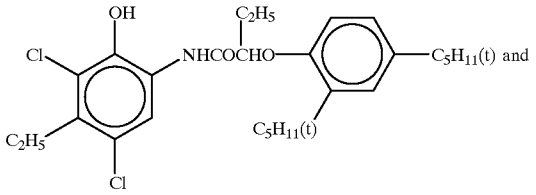
(Cpd-1) Color-image stabilizer
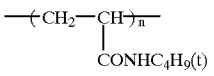
number average molecular weight 60,000
(Cpd-3) Color-image stabilizer
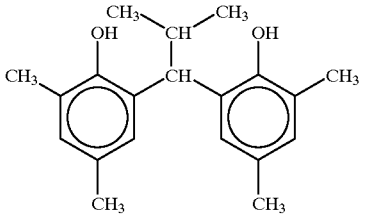
(Cpd-4) Color-mixing inhibitor
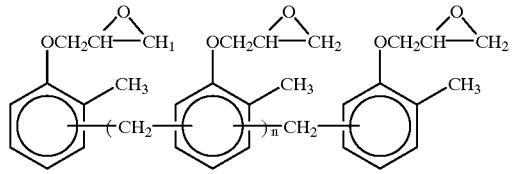
n = 7 ~ 8 (average)
(Cpd-5) Color-image stabilizer
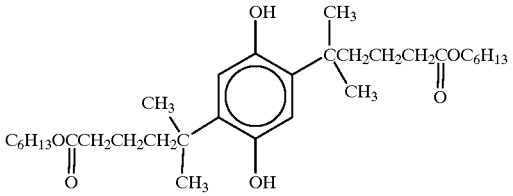
(Cpd-6) Color-image stabilizer
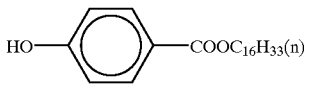
(Cpd-7) Color-image stabilizer
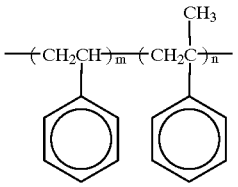
number average molecular weight 600
m/n = 10/90
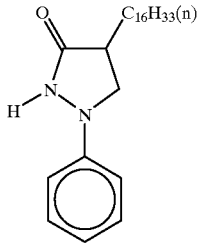

-continued
(Cpd-8) Color-image stabilizer
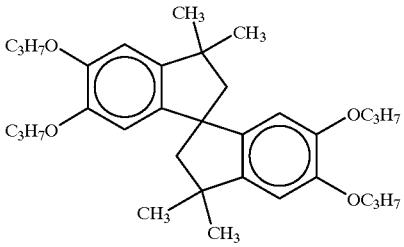
(Cpd-9) Color-image stabilizer
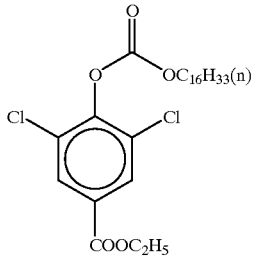
(Cpd-10) Color-image stabilizer
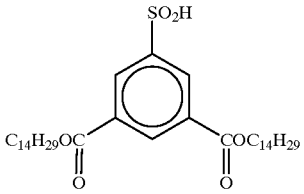
(Cpd-11)
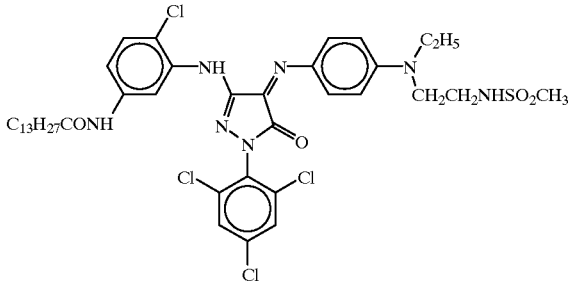
(Cpd-13) Surfactant
A mixture of 7:3 (molar ratio) of
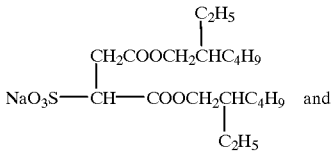
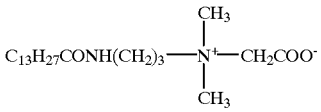
(Cpd-14)
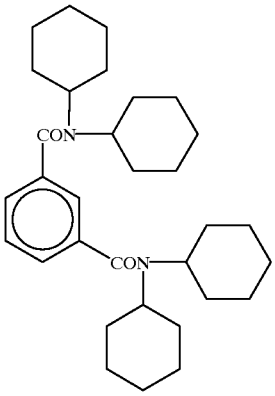
(Cpd-15)
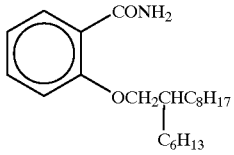
(Cpd-16)
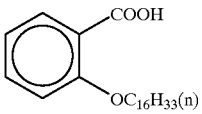
(Cpd-17)
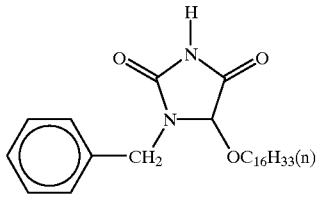

-continued (Cpd-18)

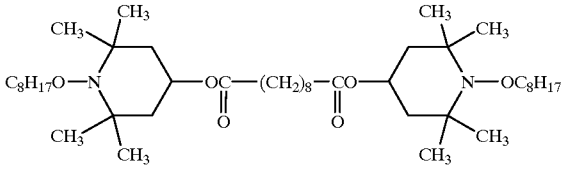

(Cpd-19) color-mixing inhibitor

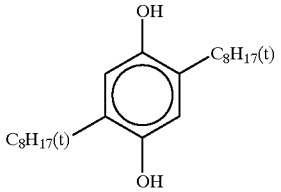

(UV-1) Ultra-violet absorbent

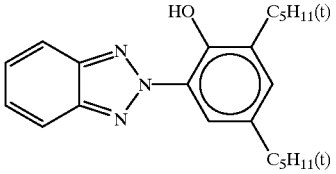

(UV-2) Ultra-violet absorbent

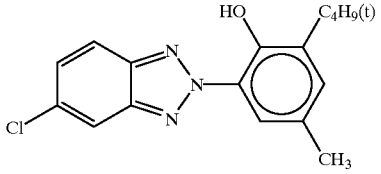

(UV-3) Ultra-violet absorbent

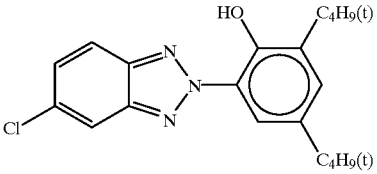

(UV-4) Ultra-violet absorbent

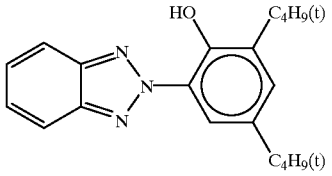

(UV-5) Ultra-violet absorbent

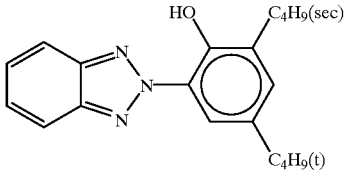

(UV-6) Ultra-violet absorbent

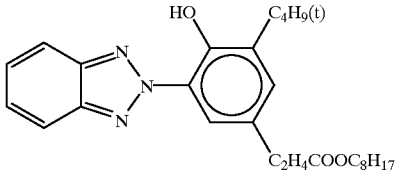

(UV-7) Ultra-violet absorbent

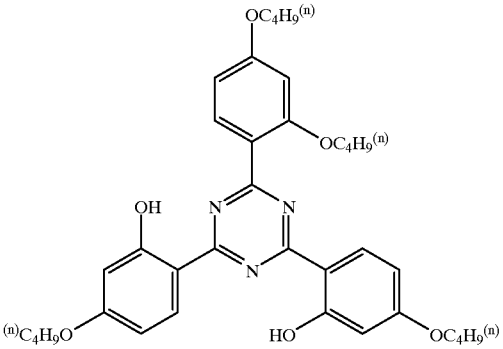

UV-A: A mixture of UV-1/UV-2/UV-3/UV-4 = 4/2/2/3 (weight ratio)
UV-B: A mixture of UV-1/UV-2/UV-3/UV-4/UV-5/UV-6 = 9/3/3/4/5/3 (weight ratio)
UV-C: A mixture of UV-2/UV-3/UV-6/UV-7 = 1/1/1/2 (weight ratio)

(Solv-1)

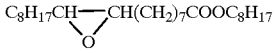

(Solv-2)

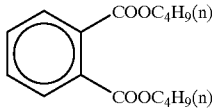

(Solv-3)

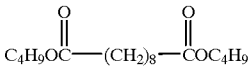

(Solv-4)

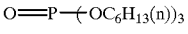

-continued (Solv-5)

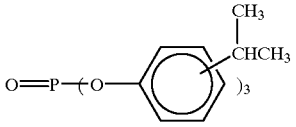

(Solv-7)

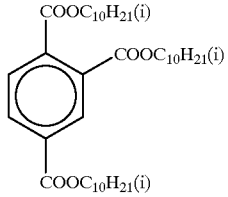

(Solv-8)

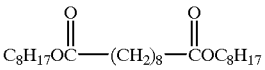

(S1-4)

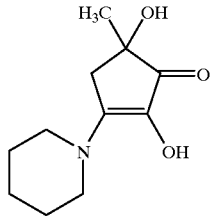

Samples (202), (203), (204), and (205) were prepared in the same manner as sample (201), except for changing Emulsion A to Emulsion D, E, F, and G, respectively.

In order to examine the photographic characteristics of these samples, the following experiments were carried out.

Experiment 1: Sensitometry of Emulsions A, D to G

Gradation exposure for a sensitometry was given to each of the coating samples by using the sensitometer (FWH type, manufactured by Fuji Photo Film Co., Ltd.). A low illumination intensity 10-second exposure was conducted by using the SP-1 filter.

Further, gradation exposure for a sensitometry was given to each of the coating samples by using the sensitometer for a high illumination intensity exposure (HIE type, manufactured by Yamashita Denso Co.). The high illumination intensity $10^{-4}$ second exposure was conducted by using the SP-1 filter.

After exposure, color development processing A as shown below was carried out.

Hereinbelow, the processing steps were described.

[Processing A]

The above Sample 203 was made into rolls of a 127-mm width; they were exposed to light imagewise, using a Mini-lab Printer Processor PP1258AR, trade name, manufactured by Fuji Photo Film Co., Ltd., and they were continuously processed (running test) in the following processing steps, until the replenishment reached to be equal to twice the color development tank volume. The process that utilized this running solution was designated as Processing A.

| Processing step | Temperature | Time | Replenishing rate* |
|---|---|---|---|
| Color developing | 38.5° C. | 45 sec | 45 ml |
| Bleach-Fixing | 38.0° C. | 45 sec | 35 ml |
| Rinse (1) | 38.0° C. | 20 sec | — |
| Rinse (2) | 38.0° C. | 20 sec | — |

-continued

| Processing step | Temperature | Time | Replenishing rate* |
|---|---|---|---|
| Rinse (3) | **38.0° C. | 20 sec | — |
| Rinse (4) | **38.0° C. | 30 sec | 121 ml |

*Replenishment rates were amounts per $m^2$ of the light-sensitive material processed.

**A Rinse Cleaning System RC50D, trade name, manufactured by Fuji Photo Film Co., Ltd., was installed in the rinse (3), and the rinse solution was taken out from the rinse (3) and was pumped to a reverse osmosis membrane module (RC50D) by a pump. The permeated water obtained in that tank was fed to a rinse (4), and the concentrated water was returned to the rinse (3). The pump pressure was adjusted so that the amount of the permeated water to the reverse osmosis membrane module would be kept at 50 to 300 ml/min, and circulation at the controlled temperature shown above was conducted for 10 hours per day. (The rinse was of a tank counter-current system from the tank (1) to the tank (4).)

The composition of each processing solution was as follows, respectively:

| | Tank Solution | Replenisher |
|---|---|---|
| [Color-developer] | | |
| Water | 800 ml | 800 ml |
| Dimethylpolysiloxane-series surface active agent (Silicone KF351A, trade name: manufactured by Shinetsu Kagaku Kogyo Co.) | 0.1 g | 0.1 g |
| Tri(isopropanol)amine | 8.8 g | 8.8 g |
| Ethylenediaminetetraacetic acid | 4.0 g | 4.0 g |
| Polyethylene glycol (molecular weight 300) | 10.0 g | 10.0 g |
| Sodium 4,5-dihydroxybenzene-1,3-disulfonate | 0.5 g | 0.5 g |
| Potassium chloride | 10.0 g | — |
| Potassium bromide | 0.040 g | 0.010 g |
| Triazinylaminostilbene-series fluorescent whitening agent (Hacchol FWA-SF; trade name, manufactured by Showa Chemical Industry Co., Ltd.) | 2.5 g | 5.0 g |
| Sodium sulfite | 0.1 g | 0.1 g |
| Disodium-N,N-bis (sulfonatoethyl) hydroxylamine | 8.5 g | 11.1 g |

-continued

| | Tank Solution | Replenisher |
|---|---|---|
| N-Ethyl-N-(β-methanesulfonamidoethyl)-3-methyl-4-amino-4-aminoaniline.3/2 sulfuric acid.monohydrate | 5.0 g | 15.7 g |
| Potassium carbonate | 26.3 g | 26.3 g |
| Water to make | 1000 ml | 1000 ml |
| pH (at 25° C./pH was adjusted by KOH and sulfuric acid) | 10.15 | 12.50 |
| [Bleach-fixing solution] | | |
| Water | 700 ml | 600 ml |
| Ethylenediaminetetraacetic acid iron (III) ammonium | 47.0 g | 94.0 g |
| Ethylenediaminetetraacetic acid | 1.4 g | 2.8 g |
| m-Carboxybenzenesulfinic acid | 8.3 g | 16.5 g |
| Nitric acid (67%) | 16.5 g | 33.0 g |
| Imidazole | 14.6 g | 29.2 g |
| Ammonium thiosulfate (750 g/liter) | 107.0 ml | 214.0 ml |
| Ammonium sulfite | 16.0 g | 32.0 g |
| Ammonium bisulfite | 23.1 g | 46.2 g |
| water to make | 1000 ml | 1000 ml |
| pH (at 25° C./pH was adjusted by acetic acid and ammonia) | 6.0 | 6.0 |
| [Rinse solution] | | |
| Sodium chlorinated isocyanurate | 0.02 g | 0.02 g |
| Deionized water (conductivity: 5 μS/cm or below) | 1000 ml | 1000 ml |
| pH | 6.5 | 6.5 |

Each of the samples thus obtained was subjected to a densitometric measurement of yellow color to obtain both 10 second low illumination intensity exposure and $10^{-4}$ second high illumination intensity exposure sensitivities of Emulsions A, and D to G, respectively. The sensitivity was determined by a reciprocal of the exposure amount required to give a color density of 1.0 above the minimum color density, and represented as a relative value, assuming that the sensitivity of the processed sample (201) is equal to 100. Further, gradation was measured by a gradient of the straight-line between the above-said sensitivity point and the sensitivity point at the density of 1.5.

Experiment 2: Latent Image Stability After Exposure

Further, each of samples was subjected to sensitometry by changing a period of time ranging from after $10^{-4}$ second high illumination intensity exposure until Processing A. A difference in sensitivity between the "post-60 minute" processing and the "post-7 second" processing was measured.

These results are shown together in Table 4.

TABLE 4

| | 10 sec. exposure | | $10^{-4}$ sec. exposure | | | |
|---|---|---|---|---|---|---|
| Sample | Sensitivity | Gradation | Sensitivity | Gradation | Difference of sensitivities between post-60 min. and post-7 min. processing | Remarks |
| 201 | 100 | 2.8 | 100 | 1.5 | 12 | Comparative example |
| 202 | 90 | 2.8 | 250 | 2.9 | 70 | Comparative example |
| 203 | 130 | 3.6 | 300 | 3.6 | 15 | This invention |
| 204 | 130 | 3.6 | 300 | 3.6 | 12 | This invention |
| 205 | 160 | 3.5 | 360 | 3.5 | 12 | This invention |

Sample (202), although a silver bromide phase existed in the grains thereof, exhibited lower value in a low illumination intensity sensitivity and soft gradation than those of Sample (201). Because an iridium compound, which is effective for improvement in high illumination intensity reciprocity law failure, was doped in the above-said grains, high illumination intensity sensitivity was resulted high. However, a change in sensitivity owing to the lapse of time ranging from after exposure until a processing, was extremely large.

On the other hand, sample (203), (204) and (205), each of which was composed of emulsion grains having non-rounded shape, each exhibited high sensitivity to a low illumination intensity, and attained hard gradation. Further, each of these samples exhibited high sensitivity to high illumination intensity, and moreover a change in sensitivity owing to the lapse of time ranging from after exposure until a processing, was small.

Example 3

Thin-layered samples were prepared by altering the layer constitution as described below. Using the samples thus prepared, the experiments 1 and 2 in Example 2 were conducted.

The layer constitution is shown by that of sample (301). Samples (302), (303), (304), (305) were samples prepared in the same manner as sample (301), except that Emulsion A was replaced by Emulsion D, E, F, and G, respectively.

Similarly to the results obtained in Example 2, each of the samples of the present invention exhibited photographic characteristics that a low illumination intensity sensitivity was high and a gradation was hard, and further high illumination intensity sensitivity was high, and moreover a change in sensitivity owing to the lapse of time ranging from after exposure until a processing, was small. From the above-described results, it was confirmed that even though thin-layered samples were subjected to an ultrarapid processing, effects of the present invention were obtained.

Preparation of Sample 301

| | |
|---|---|
| First Layer (Blue-Sensitive Emulsion Layer) | |
| Emulsion A | 0.24 |
| Gelatin | 1.25 |
| Yellow coupler (ExY) | 0.57 |
| Color-image stabilizer (Cpd-1) | 0.07 |
| Color-image stabilizer (Cpd-2) | 0.04 |
| Color-image stabilizer (Cpd-3) | 0.07 |
| Color-image stabilizer (Cpd-8) | 0.02 |
| Solvent (Solv-1) | 0.21 |
| Second Layer (Color-Mixing Inhibiting Layer) | |
| Gelatin | 0.60 |
| Color-mixing inhibitor (Cpd-19) | 0.09 |
| Color-image stabilizer (Cpd-5) | 0.007 |
| Color-image stabilizer (Cpd-7) | 0.007 |
| Ultraviolet absorber (UV-C) | 0.05 |
| Solvent (Solv-5) | 0.11 |
| Third Layer (Green-Sensitive Emulsion Layer) | |
| Silver chlorobromide emulsion B (the same emulsion as to Sample 201) | 0.14 |
| Gelatin | 0.73 |
| Magenta coupler (ExM) | 0.15 |
| Ultraviolet absorbing agent (UV-A) | 0.05 |
| Color-image stabilizer (Cpd-2) | 0.02 |
| Color-image stabilizer (Cpd-7) | 0.008 |
| Color-image stabilizer (Cpd-8) | 0.07 |
| Color-image stabilizer (Cpd-9) | 0.03 |
| Color-image stabilizer (Cpd-10) | 0.009 |
| Color-image stabilizer (Cpd-11) | 0.0001 |
| Solvent (Solv-3) | 0.06 |
| Solvent (Solv-4) | 0.11 |
| Solvent (Solv-5) | 0.06 |
| Fourth Layer (Color-Mixing Inhibiting Layer) | |
| Gelatin | 0.48 |
| Color-mixing inhibitor (Cpd-4) | 0.07 |
| Color-image stabilizer (Cpd-5) | 0.006 |
| Color-image stabilizer (Cpd-7) | 0.006 |
| Ultraviolet absorber (UV-C) | 0.04 |
| Solvent (Solv-5) | 0.09 |
| Fifth Layer (Red-Sensitive Emulsion Layer) | |
| Silver chlorobromide emulsion C (the same emulsion as to Sample 201) | 0.12 |
| Gelatin | 0.59 |
| Cyan coupler (ExC-2) | 0.13 |
| Cyan coupler (ExC-3) | 0.03 |
| Color-image stabilizer (Cpd-7) | 0.01 |
| Color-image stabilizer (Cpd-9) | 0.04 |
| Color-image stabilizer (Cpd-15) | 0.19 |
| Color-image stabilizer (Cpd-18) | 0.04 |
| Ultraviolet absorber (UV-7) | 0.02 |
| Solvent (Solv-5) | 0.09 |
| Sixth Layer (Ultraviolet Absorbing Layer) | |
| Gelatin | 0.32 |
| Ultraviolet absorber (UV-C) | 0.42 |
| Solvent (Solv-7) | 0.08 |
| Seventh Layer (Protective Layer) | |
| Gelatin | 0.70 |
| Acryl-modified copolymer of polyvinyl alcohol (modification degree: 17%) | 0.04 |
| Liquid paraffin | 0.01 |
| Surface-active agent (Cpd-13) | 0.01 |
| Polydimethylsiloxane | 0.01 |
| Silicon dioxide | 0.003 |

Thus-prepared samples were exposed to light in the same manner as in Experiments 1 and 2 in Example 2, an ultrarapid processing was carried out in accordance with color development processing B as shown below.

[Processing B]

The above Sample 303 was made into rolls of a 127-mm width; they were exposed to light imagewise, and they were continuously processed (running test) in the following processing steps, until the replenishment reached to be equal to twice the color development tank volume. The process that utilized this running solution was designated as Processing B. The processing was carried out using the mini-labo printer processor PP1258AR (trade name, manufactured by Fuji Photo Film Co., Ltd.), which was remodeled so that the conveyor speed could be enhanced in order to shorten the time of processing steps.

| Processing step | Temperature | Time | Replenishing rate* |
|---|---|---|---|
| Color developing | 45.0° C. | 12 sec | 45 ml |
| Bleach-Fixing | 40.0° C. | 12 sec | 35 ml |
| Rinse (1) | 40.0° C. | 4 sec | — |
| Rinse (2) | 40.0° C. | 4 sec | — |
| Rinse (3) | **40.0° C. | 4 sec | — |
| Rinse (4) | **40.0° C. | 4 sec | 121 ml |

*Replenishment rates were amounts per $m^2$ of the light-sensitive material processed.

**A Rinse Cleaning system RC50D, trade name, manufactured by Fuji Photo Film Co., Ltd., was installed in the rinse (3), and the rinse solution was taken out from the rinse (3) and was pumped to a reverse osmosis membrane module (RC50D) by a pump. The permeated water obtained in that tank was fed to a rinse (4), and the concentrated water was returned to the rinse (3). The pump pressure was adjusted so that the amount of the permeated water to the reverse osmosis membrane module would be kept at 50 to 300 ml/min, and circulation at the controlled temperature was conducted for 10 hours per day. (The rinse was of a tank counter-current system from the tank (1) to the tank (4).)

The composition of each processing solution was as follows, respectively:

| | Tank Solution | Replenisher |
|---|---|---|
| [Color-developer] | | |
| Water | 800 ml | 800 ml |
| Dimethylpolysiloxane-series surface active agent (Silicone KF351A, trade name: manufactured by Shinetsu Kagaku Kogyo Co.) | 0.1 g | 0.1 g |
| Tri(isopropanol)amine | 8.8 g | 8.8 g |
| Ethylenediaminetetraacetic acid | 4.0 g | 4.0 g |
| Polyethylene glycol (molecular weight 300) | 10.0 g | 10.0 g |
| Sodium 4,5-dihydroxybenzene-1,3-disulfonate | 0.5 g | 0.5 g |
| Potassium chloride | 10.0 g | — |
| Potassium bromide | 0.040 g | 0.010 g |
| Triazinylaminostilbene-series fluorescent whitening agent (Hacchol FWA-SF; trade name, manufactured by Showa Chemical Industry Co., Ltd.) | 2.5 g | 5.0 g |
| Sodium sulfite | 0.1 g | 0.1 g |
| Disodium-N,N-bis(sulfonatoethyl) hydroxylamine | 8.5 g | 11.1 g |
| N-Ethyl-N-(β-methanesulfonamidoethyl)-3-methyl-4-amino-4-aminoaniline.3/2 sulfuric acid.monohydrate | 10.0 g | 22.0 g |
| Potassium carbonate | 26.3 g | 26.3 g |
| Water to make | 1000 ml | 1000 ml |
| pH (at 25° C./pH was adjusted by KOH and sulfuric acid) | 10.15 | 12.50 |

-continued

| | Tank Solution | Replenisher |
|---|---|---|
| [Bleach-fixing solution] | | |
| Water | 700 ml | 600 ml |
| Ethylenediaminetetraacetic acid iron (III) ammonium | 75.0 g | 150.0 g |
| Ethylenediaminetetraacetic acid | 1.4 g | 2.8 g |
| m-Carboxybenzenesulfinic acid | 8.3 g | 16.5 g |
| Nitric acid (67%) | 16.5 g | 33.0 g |
| Imidazole | 14.6 g | 29.2 g |
| Ammonium thiosulfate (750 g/liter) | 107.0 ml | 214.0 ml |
| Ammonium sulfite | 16.0 g | 32.0 g |
| Ammonium bisulfite | 23.1 g | 46.2 g |
| water to make | 1000 ml | 1000 ml |
| pH (at 25° C./pH was adjusted by acetic acid and ammonia) | 5.5 | 5.2 |
| [Rinse solution] | | |
| Sodium chlorinated isocyanurate | 0.02 g | 0.02 g |
| Deionized water (conductivity: 5 μS/cm or below) | 1000 ml | 1000 ml |
| pH | 6.0 | 6.0 |

Example 4

Using Samples (301) to (305), image formation was carried out by means of laser scanning exposure.

As the light source, used were a monochromatic light of 473 nm taken out by converting the wavelength of a YAG solid laser (oscillating wavelength; 946 nm) using as an exciting light source a semiconductor laser GaAlAs (oscillating wavelength; 808.5 nm), by a SHG crystal of $LiNbO_3$ having a reversal domain structure; a monochromatic light of 532 nm taken out by converting the wavelength of a $YVO_4$ solid laser (oscillating wavelength; 1064 nm) using as an exciting light source a semiconductor laser GaAlAs (oscillating wavelength; 808.7 nm) by a SHG crystals of $LiNbO_3$ having a reversal domain structure; and AlGaInP (oscillating wavelength; 680 nm: type No. LN9R20, made by Matsushita Electric Industrial Co., Ltd.). The exposure was effected in such a manner that the three color laser beams could scan successively a sample moving vertically to the direction of the scanning, through respective rotating polygon mirrors (polyhedrons). The temperature of the semiconductor laser was kept by using a Peltier device to prevent the quantity of light from being changed by temperature. The substantial light beam diameter was 80 μm, and scanning pitch was 42.3 μm (600 dpi), and average exposure time was $1.7\times10^{-7}$ seconds per one pixel.

After exposure, these samples were subjected to color development processing B. As a result, it was found that similarly to the results of high illumination intensity exposure in Example 3, Samples (303) and (304) of the present invention exhibited high sensitivity and therefore they were also suitable for image formation comprising a laser scanning exposure.

Example 5

Tests for the grain shape were conducted by altering, in the preparation of Emulsion F, a temperature in the reaction vessel at the time when a silver nitrate aqueous solution and a potassium bromide aqueous solution were added thereto. As a result, it was found that rounded grains were formed at 40° C. or less. (The proportion of {111} tabular grains having an aspect ratio of 2 or more and a straight-line portion ratio of 0.8 or more, was 45% of the total grains.) Similarly to Example 2, samples were prepared and same experiments were conducted. However, effects of the present invention were not obtained in the samples using rounded grains, which were obtained by preparation at 40° C. or less. On the other hand, it was found that the higher temperature at which these aqueous solutions were added, the more amount of grains which were not rounded-cornered, was formed.

Further, another test of the grain shape was conducted by altering a silver potential in the reaction vessel at the time when a silver nitrate aqueous solution and a potassium bromide aqueous solution were added thereto. As a result, it was found that the lower silver potential, the much less amount of rounded grains than expected was formed.

Having described our invention as related to the present embodiments, it is our intention that the invention not be limited by any of the details of the description, unless otherwise specified, but rather be construed broadly within its spirit and scope as set out in the accompanying claims.

What I claim is:

1. A spectrally and chemically sensitized silver halide emulsion, which comprises silver halide grains, wherein 50% or more of the total projected area of the silver halide grains is provided by tabular grains having {111} planes as principal planes and having an aspect ratio of 2.0 or more, and said tabular grains contain silver iodobromochloride grains or silver bromochloride grains, each having a silver chloride content of 90 mole % or more, wherein all corners of said silver iodobromochloride grains or silver bromochloride grains do not have an intersecting point, which is formed by extending two straight-line portions of the neighboring sides on the principal plane, in the interior of the grain, and the intersecting points are substantially coincident with the actual corners of grains, making the corners angular.

2. The silver halide emulsion as claimed in claim 1, wherein an equivalent-sphere diameter of each of the silver halide grains is 0.7 μm or less.

3. The silver halide emulsion as claimed in claim 1, wherein the emulsion comprises a thiocyanate in an amount of $1\times10^{-4}$ to $3\times10^{-3}$ mol per mol of silver halide.

4. The silver halide emulsion as claimed in claim 1, wherein the emulsion is being chemically sensitized with a gold compound.

5. The silver halide emulsion as claimed in claim 1, wherein the emulsion comprises a thiosulfonic acid compound in an amount of $1\times10^{-6}$ to $5\times10^{-3}$ mol per mol of silver halide, and a sulfinic acid compound in an amount of $1\times10^{-6}$ to $1\times10^{-3}$ mol per mol of silver halide.

6. The silver halide emulsion as claimed in claim 1, wherein said silver iodobromochloride grains, or said silver bromochloride grains, have a band of a silver bromide localized phase formed at the outermost layer on the side face of the principal planes.

7. The silver halide emulsion as claimed in claim 1, wherein ratio of lengths of nearest neighboring sides of the tabular grain is 1 to 2.

8. The silver halide emulsion as claimed in claim 1, wherein straight-line portion ratio of the tabular grain is 0.8 or greater.

9. A silver halide color photographic light-sensitive material, which comprises, on a support, at least a silver halide emulsion layer containing a yellow dye-forming coupler, a silver halide emulsion layer containing a magenta dye-forming coupler, and a silver halide emulsion layer containing a cyan dye-forming coupler, wherein at least one of said emulsion layers comprises a spectrally and chemically sensitized silver halide emulsion, which comprises silver halide grains, wherein 50% or more of the total projected area of the silver halide grains is provided by tabular grains having {111} planes as principal planes and having an aspect ratio of 2.0 or more, and said tabular grains contain silver iodobromochloride grains or silver bromochloride grains, each having a silver chloride content of 90 mole % or more, wherein all corners of said silver iodobromochloride grains or silver bromochloride grains do not have an intersecting point, which is formed by extending two straight-line portions of the neighboring sides on the principal plane, in the interior of the grain, and the intersecting points are substantially coincident with the actual corners of grains, making the corners angular.

10. An image-forming method, comprising subjecting a silver halide color photographic light-sensitive material to a scanning exposure, followed by a color development process, in which, the silver halide color photographic light-sensitive material comprises, on a support, at least a silver halide emulsion layer containing a yellow dye-forming coupler, a silver halide emulsion layer containing a magenta dye-forming coupler, and a silver halide emulsion layer containing a cyan dye-forming coupler, and further, at least one of said emulsion layers comprises a spectrally and chemically sensitized silver halide emulsion, which comprises silver halide grains, wherein 50% or more of the total projected area of the silver halide grains is provided by tabular grains having {111} planes as principal planes and having an aspect ratio of 2.0 or more, and said tabular grains contain silver iodobromochloride grains or silver bromochloride grains, each having a silver chloride content of 90 mole % or more, wherein all corners of said silver iodobromochloride grains or silver bromochloride grains do not have an intersecting point, which is formed by extending two straight-line portions of the neighboring sides on the principal plane, in the interior of the grain, and the intersecting points are substantially coincident with the actual corners of grains, making the corners angular.

11. The image-forming method as claimed in claim 10, wherein the time required for said color development process is 20 seconds or less.

12. The image-forming method as claimed in claim 10, or 11, wherein said scanning exposure is carried out using a visible laser beam light of $10^{-4}$ seconds or less per pixel.

* * * * *